US010654091B2

(12) United States Patent
Stevens

(10) Patent No.: US 10,654,091 B2
(45) Date of Patent: May 19, 2020

(54) REBAR CAGE ASSEMBLY APPARATUS

(71) Applicant: Dimension Fabricators, Inc., Schenectady, NY (US)

(72) Inventor: Todd Stevens, Glenville, NY (US)

(73) Assignee: Dimension Fabricators, Inc., Schenectady, NY (US)

( * ) Notice: Subject to any disclaimer, the term of this patent is extended or adjusted under 35 U.S.C. 154(b) by 391 days.

(21) Appl. No.: 15/226,082

(22) Filed: Aug. 2, 2016

(65) Prior Publication Data

US 2018/0036788 A1 Feb. 8, 2018

(51) Int. Cl.
*B21F 27/12* (2006.01)
*B21F 23/00* (2006.01)

(52) U.S. Cl.
CPC ..... *B21F 27/124* (2013.01); *B21F 23/005* (2013.01)

(58) Field of Classification Search
CPC ..... B23P 23/00
See application file for complete search history.

(56) References Cited

U.S. PATENT DOCUMENTS 3,579,259 A * 5/1971 Kato ..... B21F 27/124 140/112
3,592,243 A * 7/1971 Fukushima ..... B21F 27/122 140/112
3,726,461 A * 4/1973 Fukushima ..... B21F 27/124 228/115
3,882,905 A * 5/1975 James ..... B21F 27/121 140/111
4,150,475 A * 4/1979 Bondpers ..... B21F 27/20 29/469
4,495,584 A * 1/1985 Yoshida ..... H02P 5/56 141/183
4,625,773 A 12/1986 Pfender
4,710,115 A * 12/1987 Tucker ..... B28B 21/24 249/64
5,133,510 A 7/1992 Davis et al.
5,271,436 A 12/1993 Pfender et al.
5,665,254 A * 9/1997 Isono ..... B21F 27/124 140/112
6,223,785 B1 * 5/2001 Barden ..... B21F 27/124 140/112
6,925,705 B2 8/2005 Neckoula
(Continued)

FOREIGN PATENT DOCUMENTS

WO 2010026547 A1 3/2010

*Primary Examiner* — Kyle O Logan
(74) *Attorney, Agent, or Firm* — Maxine L. Barasch; Keohane & D'Alessandro, PLLC

(57) ABSTRACT

A method and apparatus for rebar cage construction is disclosed. A computerized controller operates an apparatus that automates parts of the rebar cage formation process. The computer controls motors for rotating the barrel and operating a wagon containing spiral coil wire. Initial rods are placed on a plurality of latitudinal conveyors. Dual cage ring assemblies are placed on the latitudinal conveyors, and notches or slots within the cage rings engage with the initial rods. The conveyors rotate the dual cage ring assemblies and a rod dispenser places a rod in additional notches. The rods, when completely installed, form a barrel structure. A wagon containing spiral coil wire is then moved longitudinally while the conveyors rotate to wrap the spiral coil wire around the barrel, to form a spiraled rebar cage.

15 Claims, 27 Drawing Sheets

(56) References Cited

U.S. PATENT DOCUMENTS

| | | | | |
|---|---|---|---|---|
| 6,944,951 | B2 | 9/2005 | Barden | |
| 7,124,785 | B2 | 10/2006 | Barden | |
| 8,533,956 | B2 | 9/2013 | Perry | |
| 2004/0049910 | A1* | 3/2004 | Barden | B21F 27/124<br>29/700 |
| 2012/0297719 | A1* | 11/2012 | Stevens | E04C 5/0604<br>52/649.8 |

* cited by examiner

REBAR CAGE ASSEMBLY APPARATUS

FIELD OF THE INVENTION

The present invention relates generally to construction machinery, and more particularly to an apparatus for making reinforcing cages used in construction projects.

BACKGROUND

Many construction projects such as buildings, bridges, overpasses, walls, and other structures use reinforced concrete as a building material. A reinforcing cage is fabricated and assembled, and concrete poured around the cage to create a strengthened column for use in such projects. The manufacture of such cages is particularly labor intensive and typically takes considerable time to assemble. It is therefore desirable to have improvements pertaining to the assembly of such reinforcing cages.

SUMMARY OF THE INVENTION

Embodiments of the invention provide a method and apparatus for rebar cage construction. A computerized controller operates an apparatus that automates parts of the rebar cage formation process. The computer controls motors for rotating the barrel and operating a wagon containing spiral coil wire. Initial rods are placed on a plurality of latitudinal conveyors. Dual cage ring assemblies are placed on the latitudinal conveyors, and notches or slots within the cage rings engage with the initial rods. The dual cage ring assembly integrally determines the dimensions and layout of the final product (rebar cage). The conveyors rotate the dual cage ring assemblies and a rod dispenser places a rod in additional notches. The rods, when completely installed, form a barrel structure. A wagon containing spiral coil wire is then moved longitudinally while the conveyors rotate to wrap the spiral coil wire around the barrel, to form a spiraled rebar cage.

In a first aspect, embodiments of the present invention provide an apparatus comprising: a driveshaft; a first motor coupled to the driveshaft; a plurality of latitudinal conveyors coupled to the driveshaft, wherein each conveyor comprises a plurality of rod guides; a longitudinal rail disposed alongside the plurality of latitudinal conveyors; a wagon configured to travel along the longitudinal rail such that it passes adjacent to each of the plurality of latitudinal conveyors; a second motor configured to move the wagon along the longitudinal rail; and a controller comprising a processor and a memory containing instructions, that when executed by the processor, control operation of the first motor and the second motor.

In a second aspect, embodiments of the present invention provide an apparatus comprising: a driveshaft; a first motor coupled to the driveshaft; a plurality of latitudinal conveyors coupled to the driveshaft, wherein each conveyor comprises a plurality of rod guides; a longitudinal rail disposed alongside the plurality of latitudinal conveyors; a wagon configured to travel along the longitudinal rail such that it passes adjacent to each of the plurality of latitudinal conveyors; a second motor configured to move the wagon along the longitudinal rail; and a controller comprising a processor, a user interface coupled to the processor, and a memory containing instructions, that when executed by the processor, control operation of the first motor and the second motor, and perform the steps of: prompting a user to load an initial plurality of rods via the user interface; prompting a user to load a plurality of dual-ring cage assemblies; detecting a dispensing position of the plurality of dual-ring cage assemblies; and dispensing a rod into a notch of the plurality of dual-ring cage assemblies.

In a third aspect, embodiments of the present invention provide a method for assembling a rebar cage, comprising: placing an initial plurality of rods on a plurality of latitudinal conveyors; placing a plurality of dual-ring cage assemblies on the initial plurality of rods; operating the plurality of latitudinal conveyors to rotate the plurality of dual-ring cage assemblies to a rod reception position; dispensing a rod into a notch of the plurality of dual-ring cage assemblies; repeating the operating and dispensing until a predetermined number of rods are dispensed; connecting a spiral wire to one of the plurality of rods; and operating the plurality of latitudinal conveyors simultaneously while operating a wagon along a longitudinal rail to create a spiral wire around the plurality of dual-ring cage assemblies.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

The drawings are not necessarily to scale. The drawings are merely representations, not intended to portray specific parameters of the invention. The drawings are intended to depict only typical embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Embodiments of the present invention provide an improved method and apparatus for rebar cage construction. Initial rods are placed on a plurality of latitudinal conveyors. Dual cage ring assemblies are placed on the latitudinal conveyors, and notches or slots within the cage rings engage with the initial rods. The conveyors rotate the dual cage ring assemblies and a rod dispenser places a rod in additional notches. The rods, when completely installed, form a barrel structure. A wagon containing spiral coil wire is then moved longitudinally while the conveyors rotate to wrap the spiral coil wire around the barrel, to form a spiraled rebar cage.

Reference throughout this specification to "one embodiment," "an embodiment," "some embodiments", or similar language means that a particular feature, structure, or characteristic described in connection with the embodiment is included in at least one embodiment of the present invention. Thus, appearances of the phrases "in one embodiment," "in an embodiment," "in some embodiments", and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
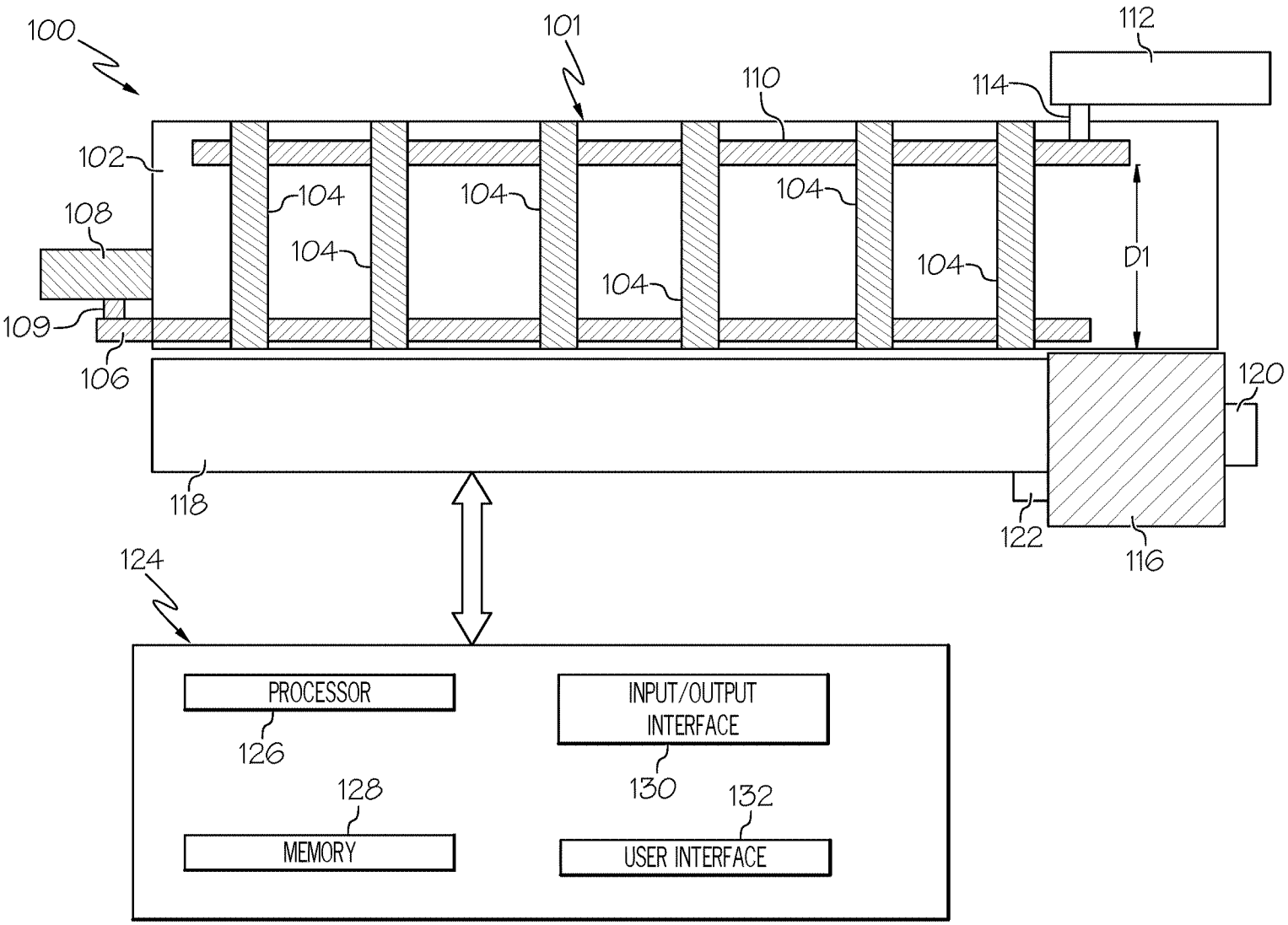
FIG. 1 shows a block diagram of a system in accordance with embodiments of the present invention.

FIG. 1 shows a block diagram of a system 100 in accordance with embodiments of the present invention. System 100 includes rebar cage assembly apparatus 101 and controller 124. The controller 124 comprises a processor 126 coupled to memory 128. Memory 128 may be non-volatile memory that contains instructions, which when executed by the processor, control the operation of the apparatus 101. The memory may include, but is not limited to, RAM, ROM, Flash, SRAM, optical storage devices, magnetic disk devices, and solid state disk (SSD) devices. Memory may not be a transitory signal per se. Controller 124 may further include an input/output interface 130 which may be configured to receive input from various sensors on the apparatus 101. The controller 124 may further include a user interface 132 which may be a touch screen, a display, and/or dedicated buttons.

Apparatus 101, shown in a top-down schematic view, comprises a chassis 102 upon which a plurality of latitudinal conveyors, each labeled as 104 on FIG. 1, are disposed. The latitudinal conveyors may include a chain or belt that is configured and disposed to spin a rebar cage assembly. Although six latitudinal conveyors are shown, in implementations, more or fewer may be included. Each latitudinal conveyor may be coupled to a driveshaft 106. A conveyor motor 108 is coupled to the driveshaft 106 via drive gear 109. The conveyor motor 108 may be an electric motor. In embodiments, the drive gear 109 may be moveable as to disengage from the motor 108, such that the conveyors can be moved independently of the motor 108. This allows alignment of the conveyors 104.

Apparatus 101 further comprises a wagon 116, which is configured and disposed to move along a longitudinal wagon rail 118 disposed alongside the plurality of latitudinal conveyors 104 such that the wagon travels adjacent to each of the plurality of latitudinal conveyors 104. The wagon is configured and disposed to carry a spool of spiral wire for wrapping around a formed rebar cage. Wagon motor 120 is configured to move the wagon 116 along the longitudinal wagon rail 118. A positional encoder 122 may be configured to measure a distance travelled by, or otherwise track the position of, the wagon 116 along the wagon rail 118. The output of the encoder 122 may be input to the controller 124 via the input/output interface 130.

Apparatus 101 further comprises a strut 110 configured and disposed to adjust the plurality of conveyors 104 so that the conveyors can accommodate cages of various diameters. A conveyor adjustment shaft 114 is configured and disposed to move the strut 110, which adjusts the diameter settings of each of the conveyors 104. A conveyor adjustment shaft power source 112 moves the conveyor adjustment shaft 114 to accomplish the adjustment. In embodiments, the conveyor adjustment shaft 114 may be a pneumatic cylinder and the conveyor adjustment shaft power source 112 may be a compressor. In other embodiments, the conveyor adjustment shaft may be a threaded shaft and the conveyor adjustment shaft power source 112 may be an electric motor. As shown in FIG. 1, the strut 110 is at a distance D1 from the opposite end of the chassis 102.

Figure 2:
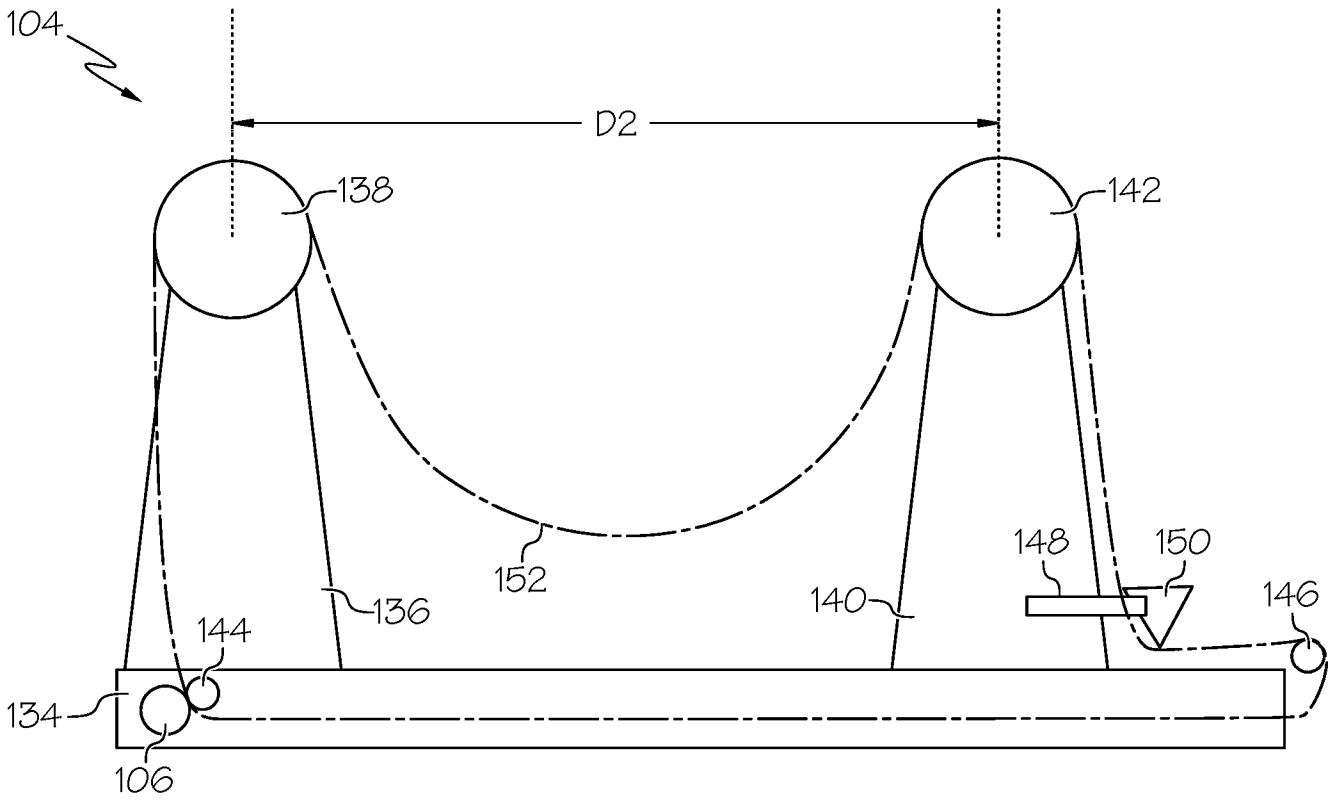
FIG. 2 is a side view of a conveyor for a large diameter cage.

FIG. 2 is a side view of a conveyor 104 configured for a large diameter cage. In embodiments, the cages may range in diameter from about 48 inches to about 144 inches. Latitudinal conveyor 104 comprises a base 134. A fixed arm 136 is attached to the base 134. A fixed arm sprocket 138 is rotatably attached to the top end of the fixed arm 136. A moveable arm 140 is moveably secured to the base 134. A moveable arm sprocket 142 is rotatably attached to the top end of the moveable arm 140. On the outside of the moveable arm 140 is a chain tensioner that comprises tensioner gear 146, tensioner flange 148, and tensioner guide 150. A chain 152 is disposed to be engaged by the fixed arm sprocket 138, the moveable arm sprocket 142, tensioner gear 146, and drive gear 144. The driveshaft 106 rotates drive gear 144 which moves the chain 152. The fixed arm sprocket 138 is separated from the moveable arm sprocket 142 by a distance D2. The chain 152 droops down between the fixed arm sprocket 138 and the moveable arm sprocket 142. The moveable arm 140 can be moved closer to the fixed arm 136 to accommodate smaller diameter cages.

Figure 3:
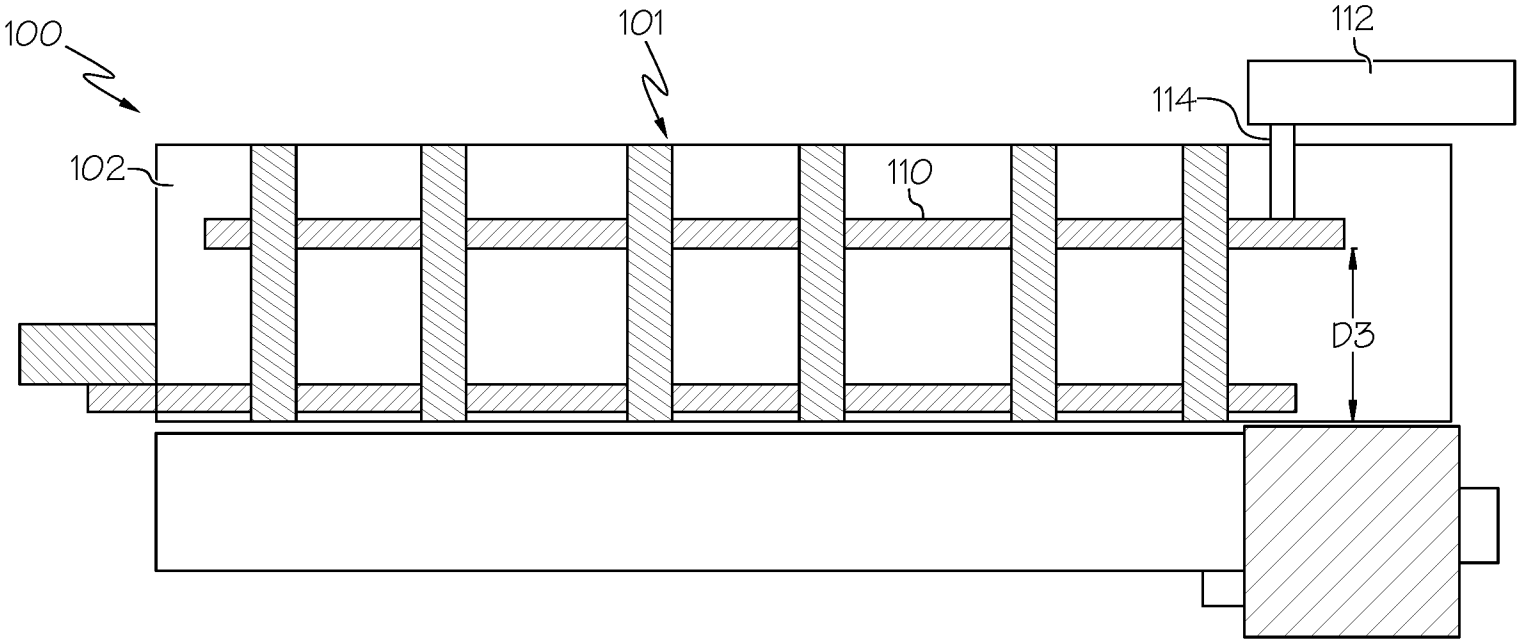
FIG. 3 shows a block diagram indicating configuration for a smaller diameter cage

FIG. 3 shows an apparatus 101 indicating configuration for smaller diameter cage as compared with the configuration shown in FIG. 1. As shown in FIG. 3, the conveyor adjustment shaft power source 112 has extended to move the conveyor adjustment shaft 114. As shown in FIG. 3, the strut 110 is at a distance D3 from the opposite end of the chassis 102, where D3<D1 of FIG. 1. Thus, the apparatus 101 comprises an extension mechanism configured and disposed to move the moveable arm of each latitudinal conveyor in a latitudinal direction to adjust a cage diameter. In operation, each of the plurality of latitudinal conveyors is set to the same distance.

Figure 4:
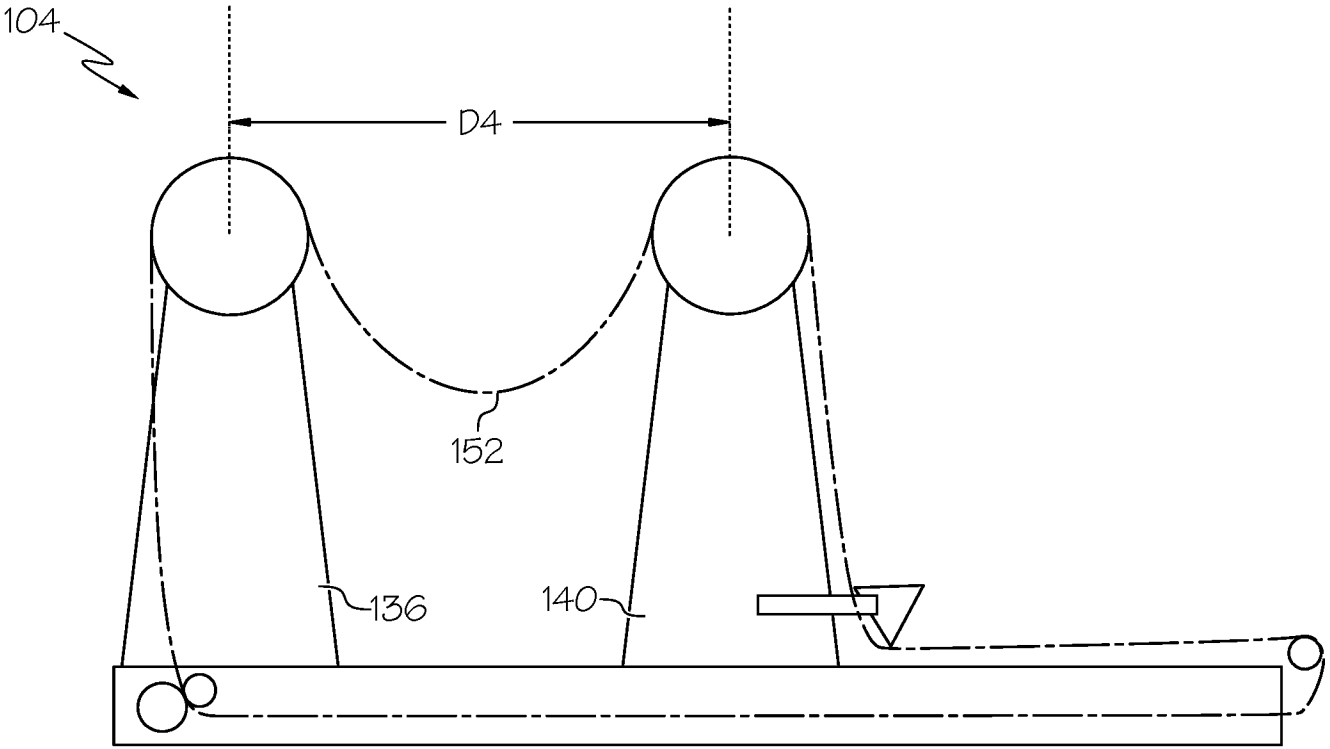
FIG. 4 is a side view of a conveyor for a smaller diameter cage

FIG. 4 is a side view of a conveyor 104 for a smaller diameter cage. The strut (110 of FIG. 3) is coupled to the moveable arm 140 such that it can be moved towards the fixed arm 136, resulting in a distance D4 between the moveable arm 140 and the fixed arm 136, where D4<D2 of FIG. 2. As a result, the contour of chain 152 accommodates a smaller diameter cage than in the configuration shown in FIG. 2.

Figure 5:
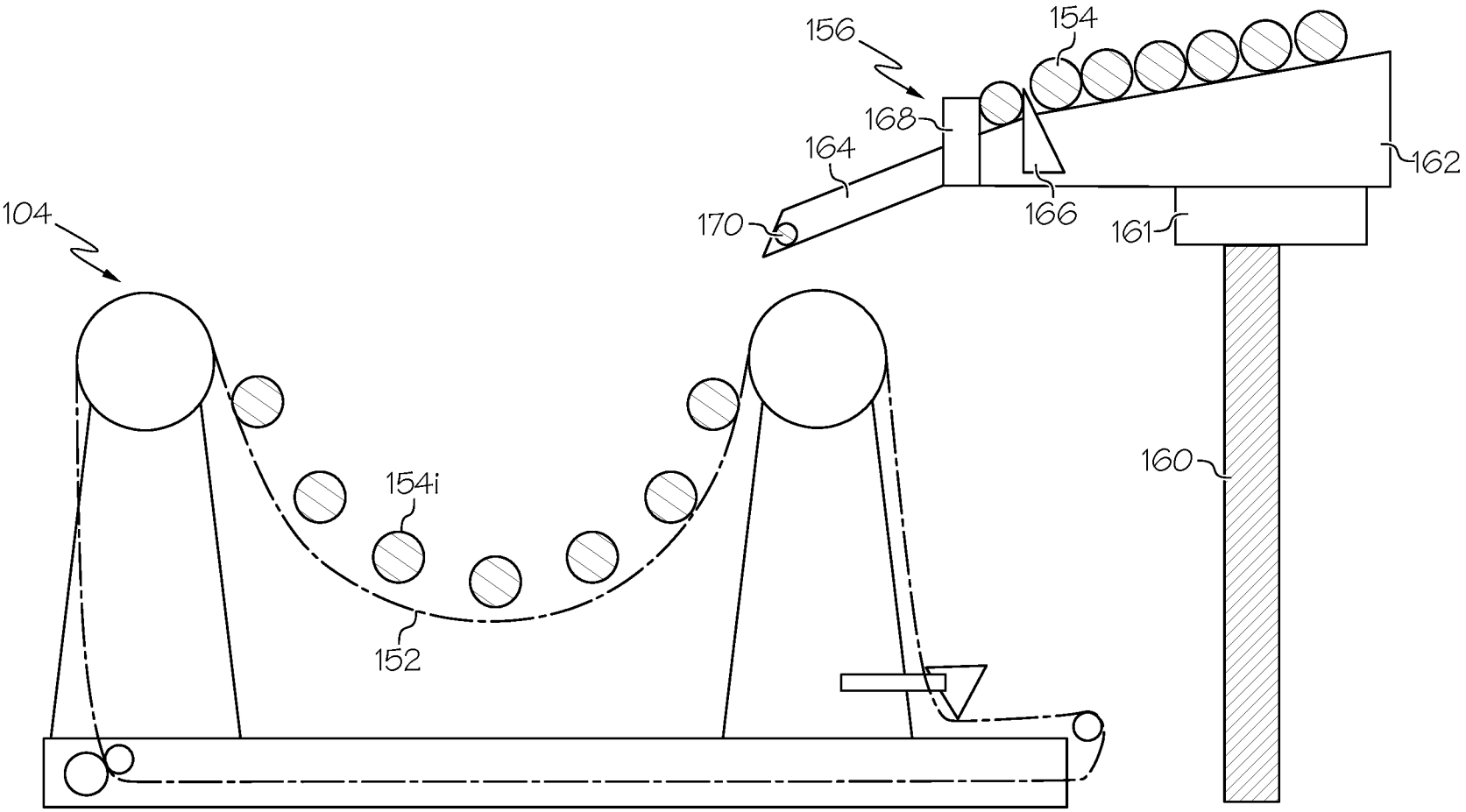
FIG. 5 is a side view indicating initial rod placement.

FIG. 5 is a side view indicating initial rod placement. To build a rebar cage using disclosed embodiments, a plurality of rods, an example of which is labeled 154*i*, are placed on the chain 152. The rods 154*i* that are initially placed on the chain are referred to as initial rods. A rod dispenser 156 is configured and disposed to dispense rods into cage ring assemblies. The rod dispenser 156 may include a support 160 and a platform 161 that is disposed on the support 160. In embodiments, the platform 161 is adjustable in height and in angle with respect to the latitudinal conveyor 104. The rod dispenser 156 may further include a dispensing tray 162 on which additional rods, an example of which is labeled 154 may be loaded. A first gate 166 may be electrically controlled to keep the rods 154 in place on the dispensing tray 162. A second gate 168 may be electrically controlled to release a single rod onto the dispenser chute 164. A position sensor 170 may be incorporated into the end of the chute 164 to detect a slot within a cage ring assembly. In embodiments, sensor 170 is a magnetic proximity sensor. In other embodiments, sensor 170 may include a laser sensor, infrared sensor, or other suitable sensor. In embodiments, detecting a dispensing position comprises reading a signal from a magnetic proximity sensor to determine a location of the notch. In other embodiments, detecting a dispensing position comprises reading a signal from a laser sensor to determine a location of the notch.

In operation, the plurality of latitudinal conveyors rotates a cage until a slot is in position to receive a rod, as detected by sensor 170. When sensor 170 detects presence of a cage slot, the controller (124 of FIG. 1) receives a signal from the sensor 170 via the input/output interface (130 of FIG. 1). The processor 126 then issues a stop to the conveyor motor (108 of FIG. 1). With the cage stopped, the rod can be dispensed. Dispensing the rod may include releasing the second gate 168 so that the next rod can be dispensed. Then the second gate is restored, at which point, the first gate 166 is temporarily released to allow another rod to roll down to the second gate 168. The first gate 166 is then restored to prevent additional rods from rolling. In this way, only one rod is dispensed at a time. Thus, in embodiments, a rod dispensing mechanism is configured and disposed to dispense a rod into a slot of a cage ring that is disposed on the plurality of latitudinal conveyors.

Figure 6:
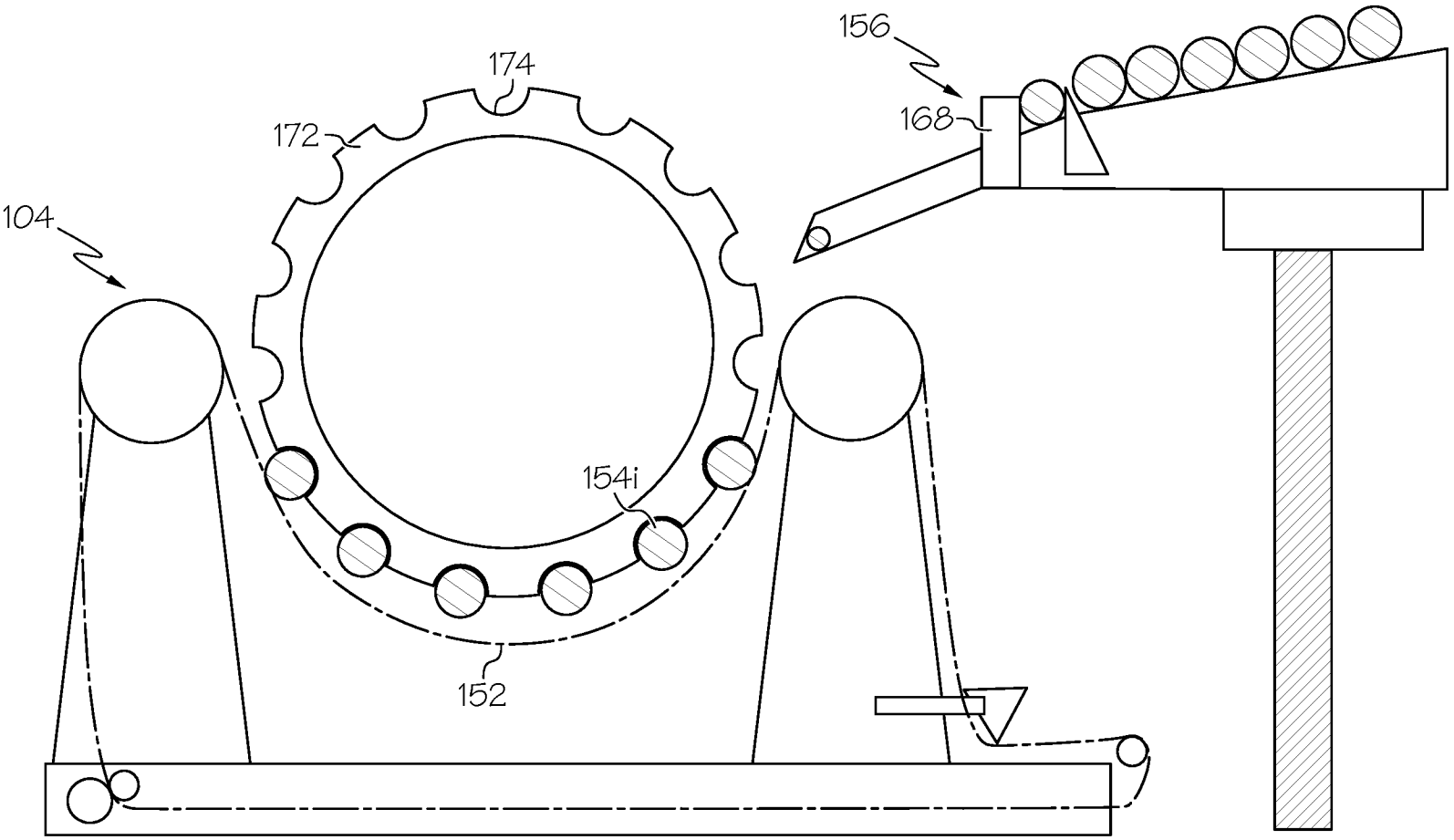
FIG. 6 is a side view indicating dual cage ring assembly placement.

FIG. 6 is a side view indicating dual cage ring assembly placement. A rebar cage ring 172 comprising a plurality of slots 174 is placed on the chain 152 such that each initial rod 154*i* is disposed within a slot of the cage ring 172. The cage ring may be a stiffener ring such as that disclosed by U.S. Pat. No. 8,387,329, the entire contents of which are incorporated by reference herein.

Figure 7:
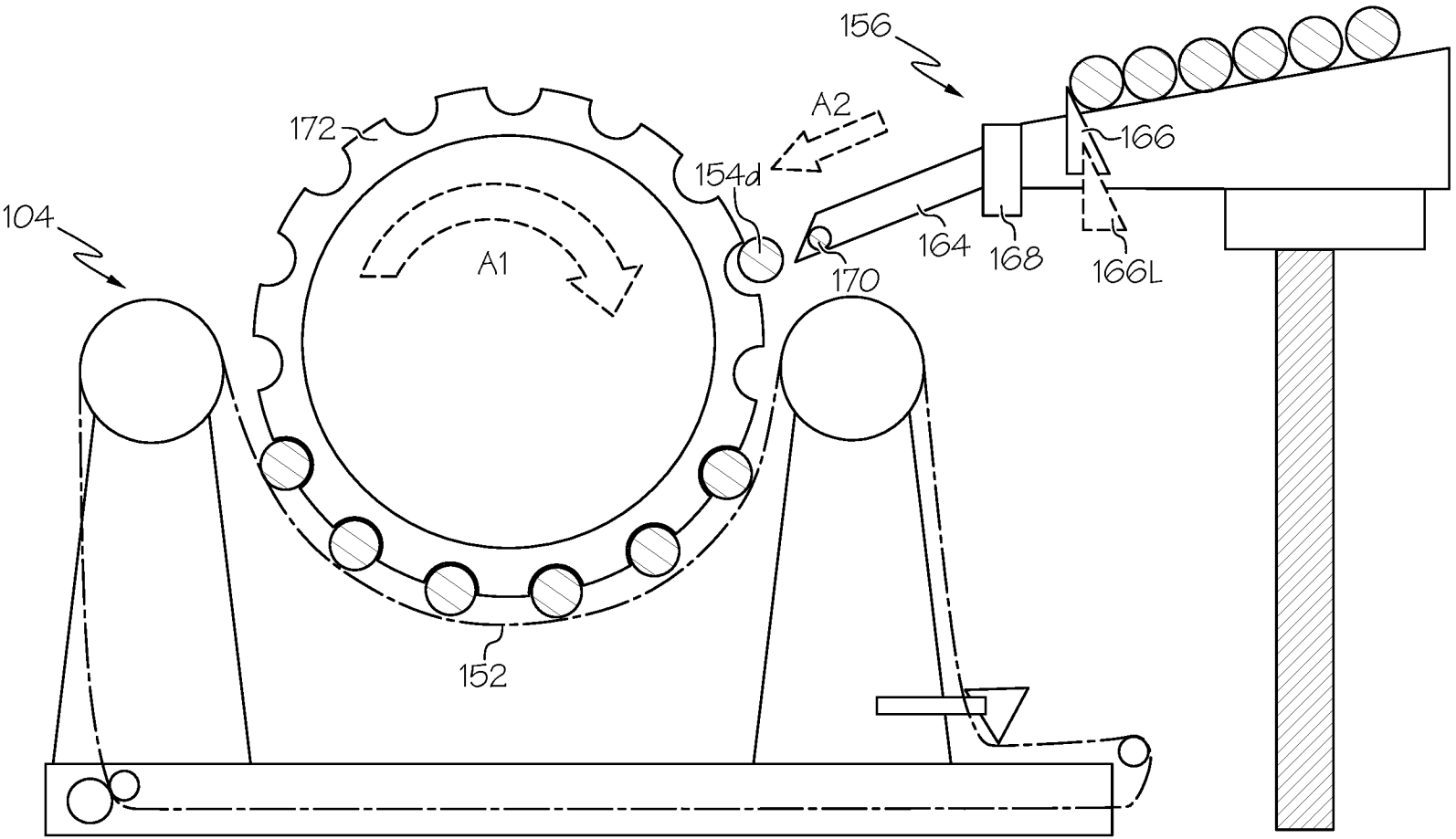
FIG. 7 shows installation of an additional rod.

FIG. 7 shows installation of an additional rod. As shown in FIG. 7, the conveyor 104 is operated to move its chain so that the cage ring 172 turns in the direction as indicated by arrow A1. When the proximity sensor 170 detects a notch of the cage ring 172 aligned with the tip of the dispenser chute 164, the cage ring 172 is deemed to be in a dispensing position, or rod reception position, and the conveyor 104 is stopped. A rod indicated as 154*d* is then dispensed by lowering second gate 168 so that a rod can roll in the direction indicated by arrow A2, into place within the notch of the cage ring 172. The rod may then be secured to the cage ring by metal ties, clamps, tack welding, or other suitable technique. Once the rod is dispensed, the second gate 168 reverts to its raised position as shown in FIG. 6, and the first gate 166 then releases to the lower position as indicated by 166L to allow another rod to move adjacent to the second gate 168 to be in position for dispensing. Then, the first gate reverts to a raised position as indicated by 166 with a rod ready for dispensing as shown in FIG. 6. As can be seen in FIG. 7, the rods are disposed on the outside of the cage ring 172.

Figure 8:
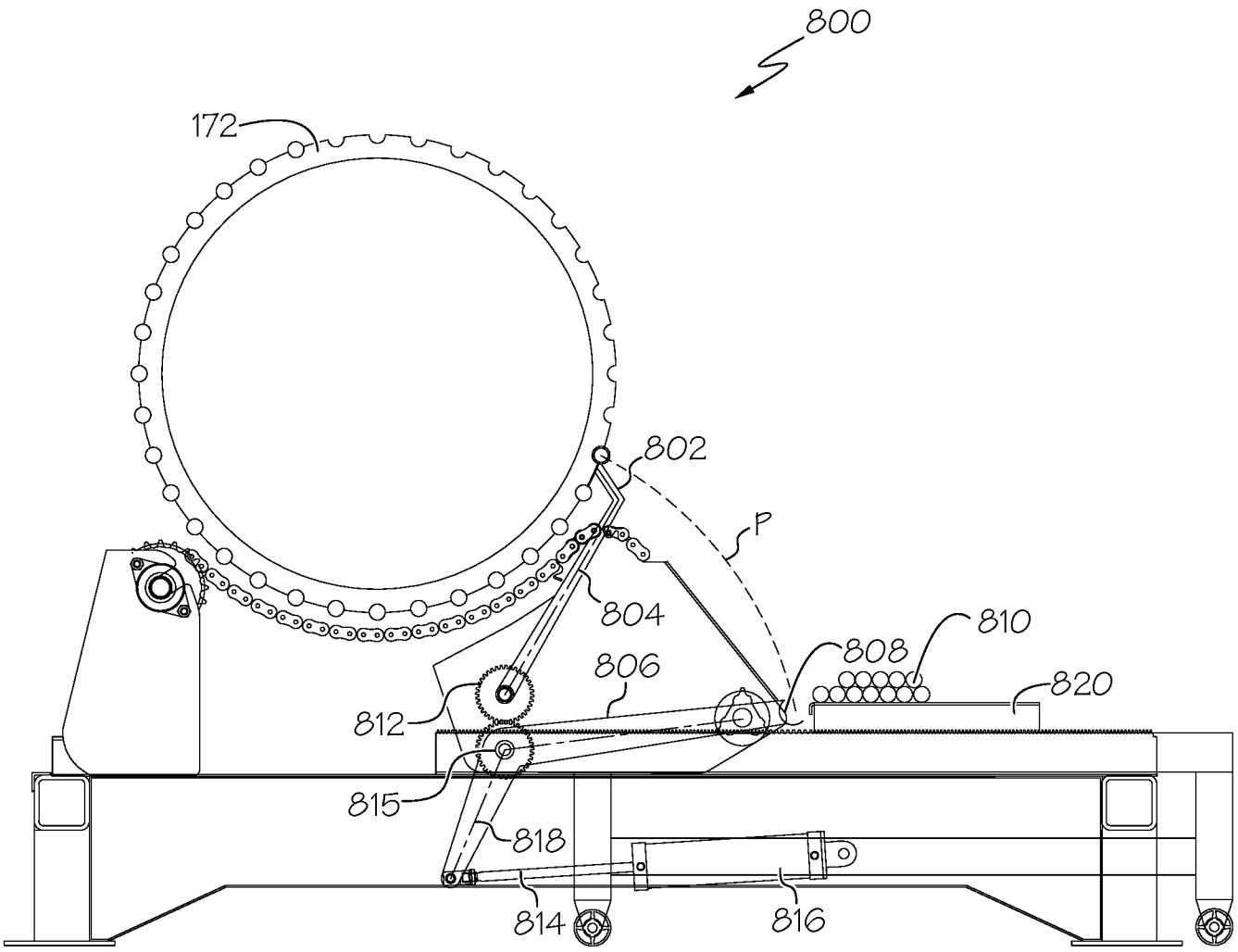
FIG. 8 shows an alternative embodiment of a rod dispenser.

FIG. 8 shows an alternative embodiment of a rod dispenser. Rod dispenser 800 includes a proximity sensor 802 disposed at the distal end of arm 804. The other end of arm 804 is attached to a rotatable gear 812, such that the arm 804 can be adjusted to accommodate different diameter cages. A platform 820 is configured and disposed to support a plurality of rods, an example of which is labeled 810, that are to be loaded into the rebar cage ring 172. A rod may be manually placed into rod holder 808 which is at the distal end of arm 806, which is mechanically coupled to arm 818. Arm 806 and arm 818 are rotatable around hub 815, such that when post 814 of piston 816 is extended, the rod holder 808 moves upward along path P to install a rod in the cage ring 172.

Figure 9:
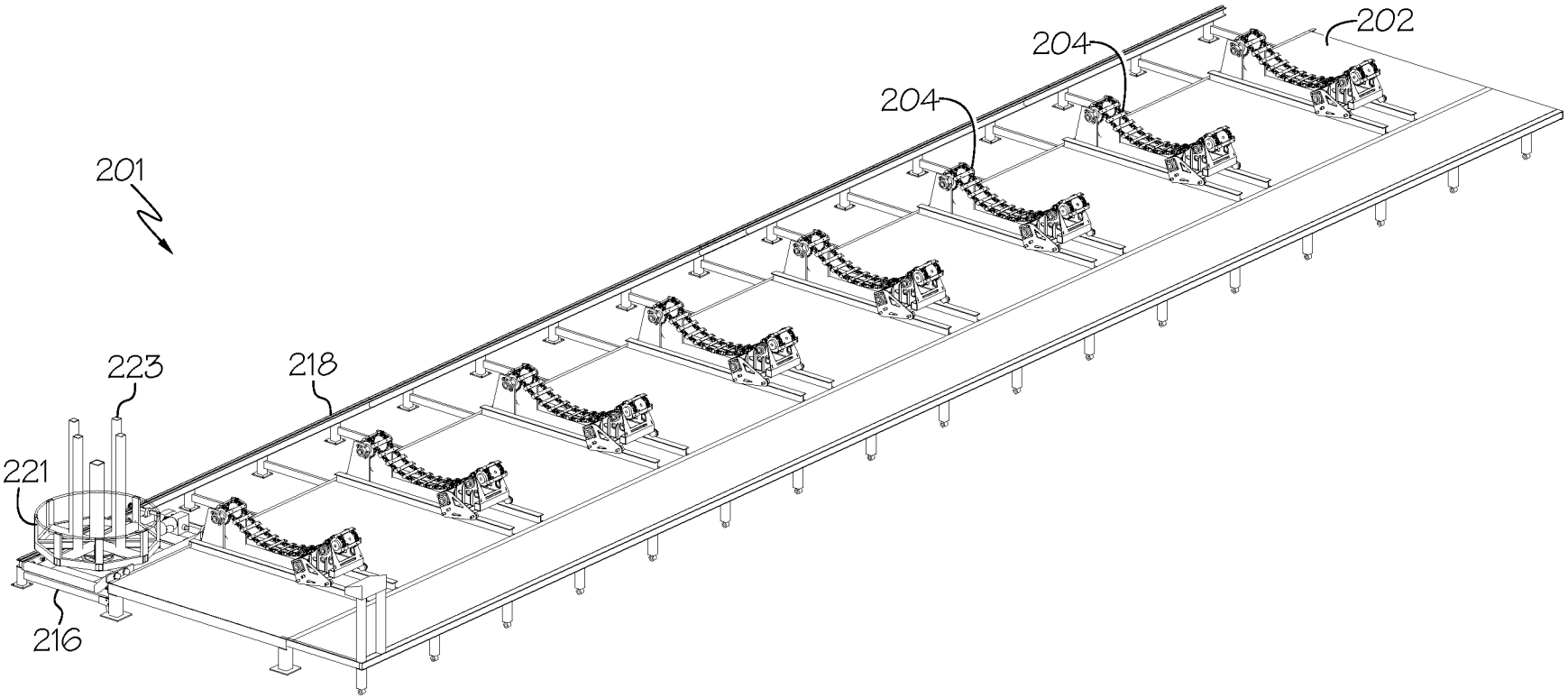
FIG. 9 shows a perspective view of latitudinal conveyors.

FIG. 9 shows a perspective view of an apparatus 201 in accordance with an exemplary embodiment. Apparatus 201 includes latitudinal conveyors, examples of which are labeled 204, installed on a chassis 202. A longitudinal wagon rail 218 is disposed along the long axis of the chassis 202. A wagon 216 is configured and disposed to move along the wagon rail 218. The wagon 216 comprises at least one wagon spindle 223 to support a spool of wire. A wagon cage 221 serves to keep the spool in place during operation.

Figure 10A:
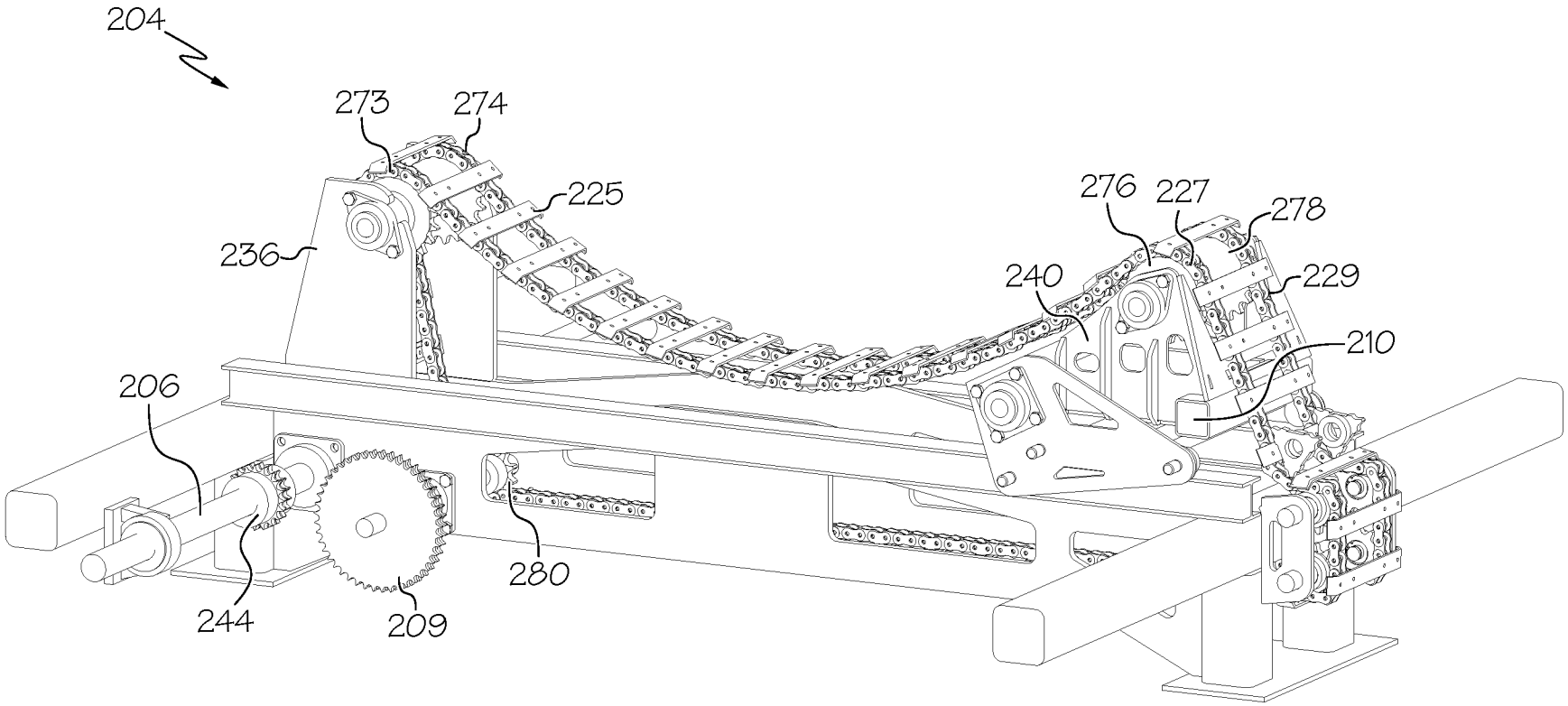
FIG. 10A shows detail of a latitudinal conveyor of an exemplary embodiment.

FIG. 10A shows detail of a latitudinal conveyor 204 of an exemplary embodiment. Latitudinal conveyor 204 comprises a fixed arm 236 and a moveable arm 240. Fixed arm 236 includes a first fixed arm pulley 273 and a second fixed arm pulley 274. Moveable arm 240 includes a first moveable arm pulley 276 and a second moveable arm pulley 278. A first chain 227 is coupled to the first fixed arm pulley 273 and the first moveable arm pulley 276. A second chain 229 is coupled to the second fixed arm pulley 274 and the second moveable arm pulley 278. A plurality of rod guides, an example of which is labeled 225, are connected to both the first chain 227 and the second chain 229. The rod guides 225 are spaced apart from each other such that rods can be placed between two adjacent rod guides 225, and held in place by the rod guides 225. Thus, during placement of initial rods (depicted in FIG. 5), the rod guides 225 keep the initially placed rods in position. In embodiments, each of the plurality of latitudinal conveyors comprises a second fixed arm pulley attached to the fixed arm and a second moveable arm pulley attached to the moveable arm, and a first chain and a second chain, wherein the first chain is coupled to the first fixed arm pulley and the first moveable arm pulley, and wherein the second chain is coupled to the second fixed arm pulley and the second moveable arm pulley, and wherein the first chain is connected to the second chain by the plurality of rod guides.

Driveshaft 206 is mechanically coupled to drive gear 244 which engages with reduction gear 209 that is mechanically coupled to chain gear 280, which moves the second chain 229. A substantially similar chain gear (not visible in this figure) may be mechanically coupled to the first chain 227. As the chains are moved, a cage disposed on the conveyor 204 can rotate.

Strut 210 is mechanically coupled to the moveable arm 240, such that when the strut 210 is pushed or pulled by a mechanism such as a pneumatic cylinder (not shown), the moveable arm 240 moves closer or further from the fixed arm 236 to accommodate cages of various diameters.

Figure 10B:
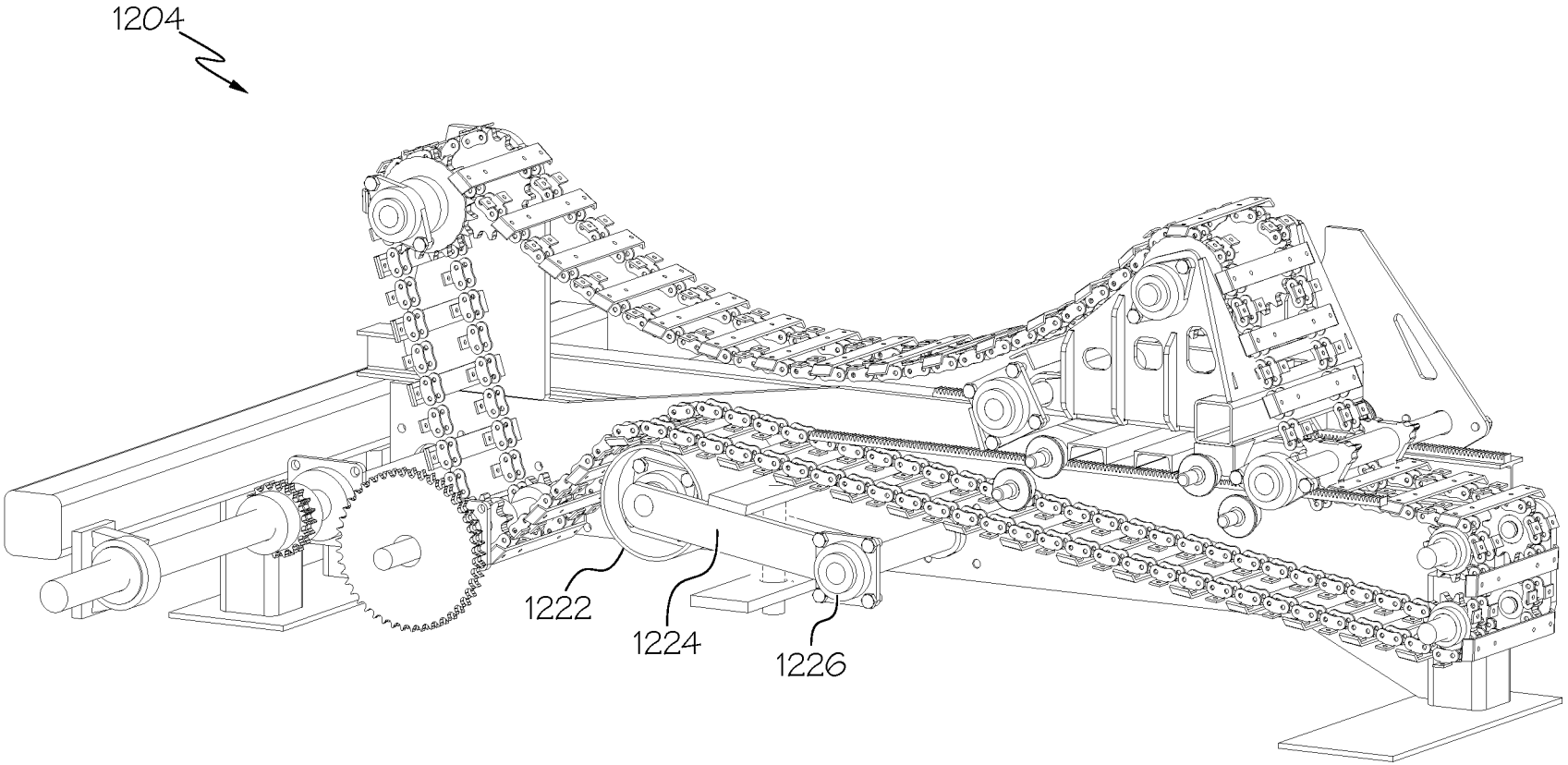
FIG. 10B and FIG. 10C show detail of a latitudinal conveyor of an alternative embodiment.
Figure 10C:
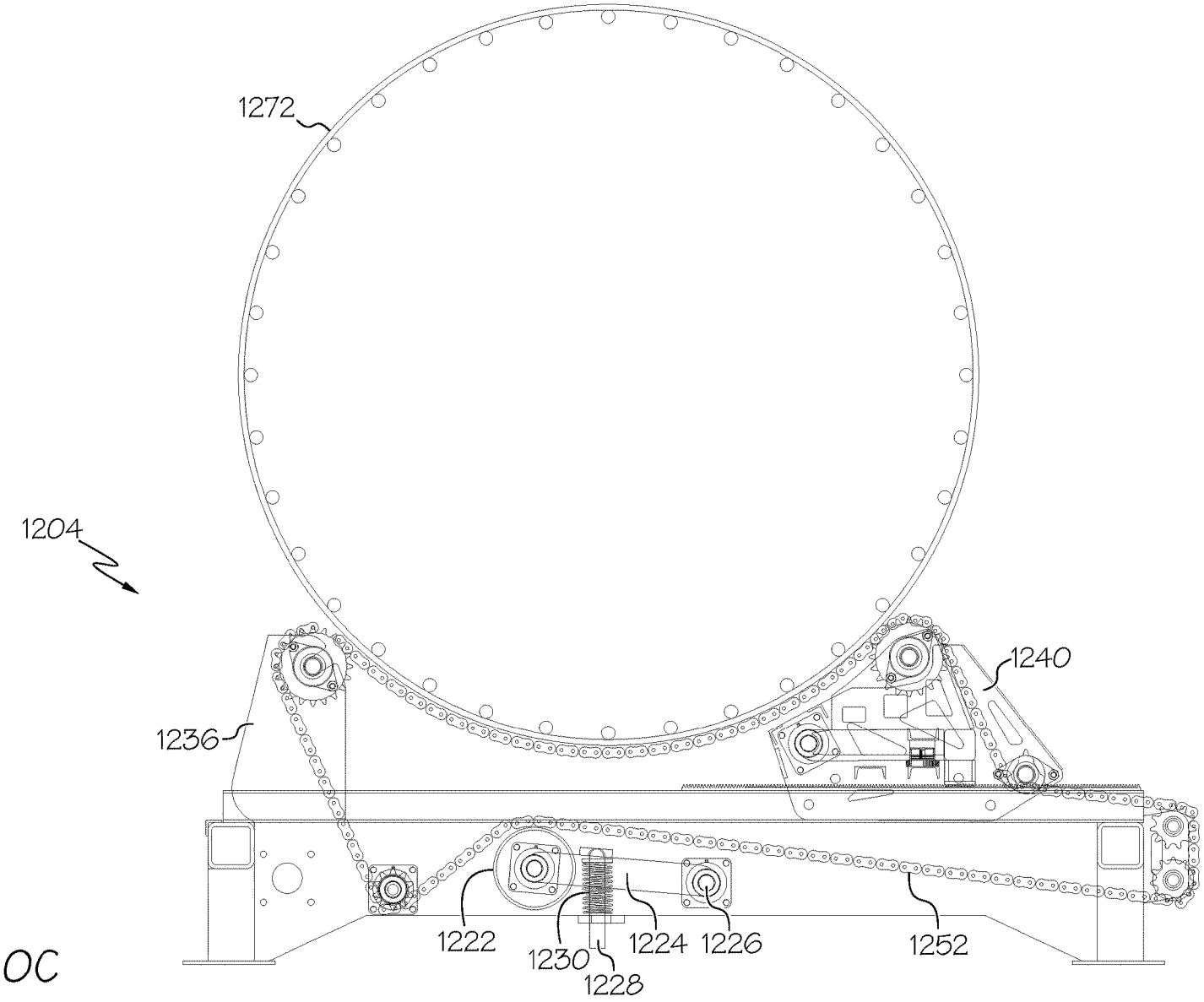

FIG. 10B and FIG. 10C show detail of a latitudinal conveyor of the alternative embodiment. Referring now to FIG. 10B, the alternative embodiment of latitudinal conveyor 1204 further comprises a spring tensioner mechanism comprising a tensioner drum 1222 that is affixed to a tensioner lever 1224 at one end. The tensioner lever 1224 is affixed to a tensioner bearing 1226 at the opposite end. Referring now to FIG. 10C, a side view of the latitudinal conveyor 1204 is shown with a rebar cage ring 1272 disposed thereon. As can be seen in FIG. 10C, the spring tensioner mechanism further includes a spring 1230 disposed around shaft 1228 and connected to the tensioner lever 1224 at a point between the tensioner drum 1222 and the tensioner bearing 1226. The spring 1230 exerts an upward force on the tensioner drum 1222, such that when the moveable arm 1240 is moved relative to the fixed arm 1236, the tensioner drum 1222 moves to take up additional slack in the chain 1252. In some embodiments, spring 1230 is a coil spring. In other embodiments, spring 1230 may be implemented via a leaf spring, hydraulic strut, or other suitable mechanism.

Figure 11A:
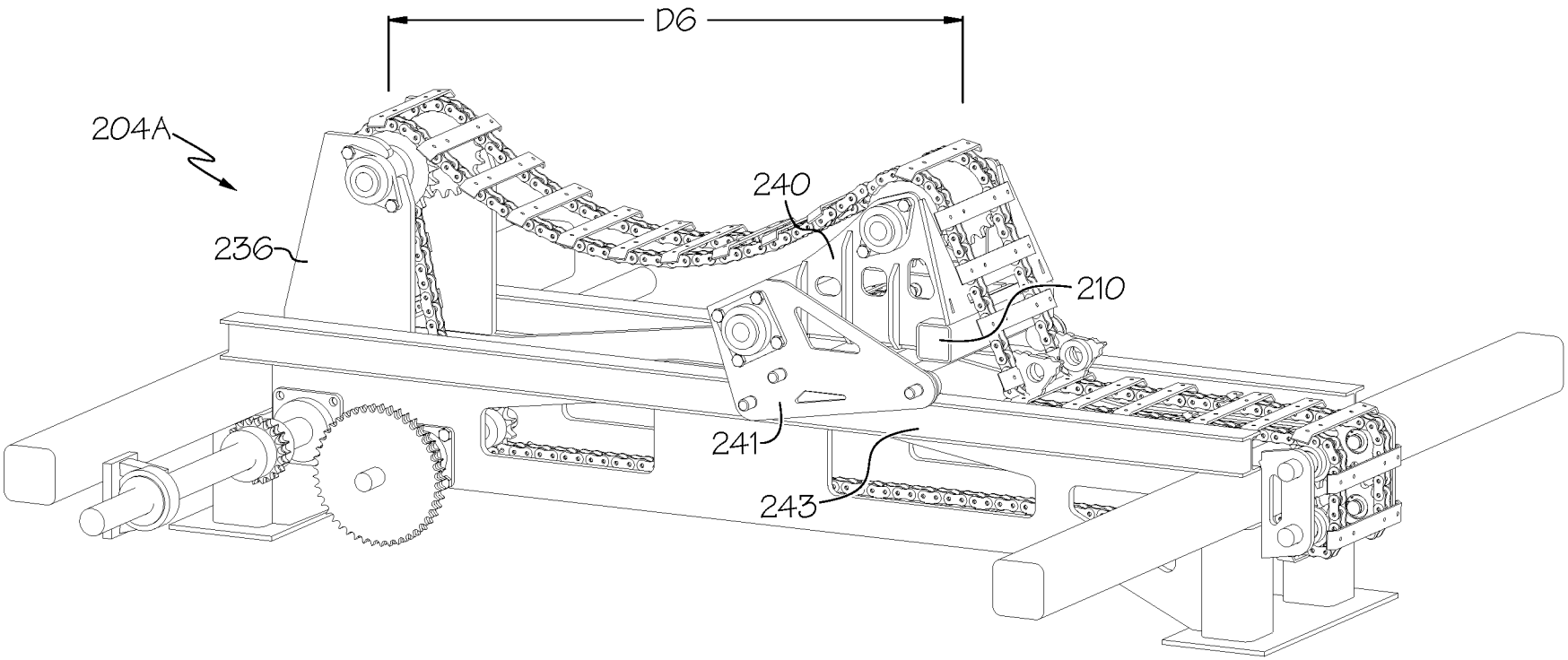
FIGS. 11A and 11B show an exemplary embodiment of a latitudinal conveyor in two different diameter configurations.
Figure 11B:
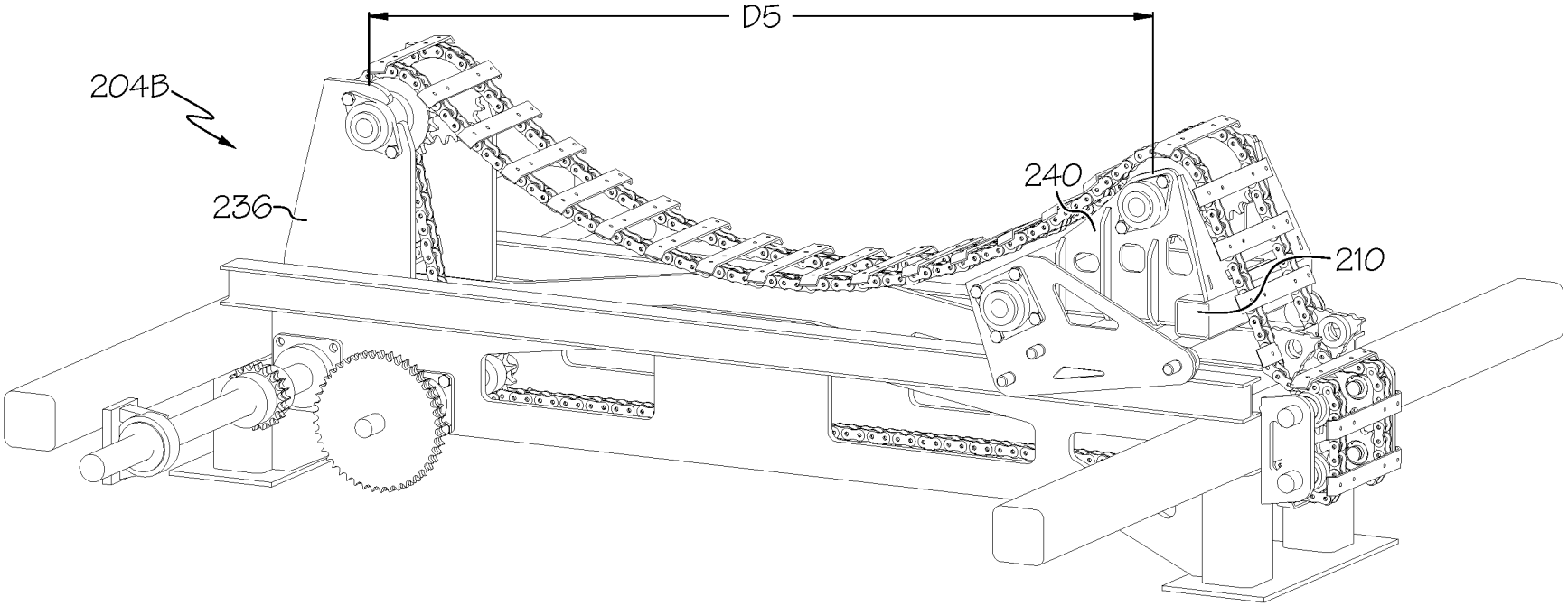

FIG. 11A and FIG. 11B show an exemplary embodiment of a latitudinal conveyor in two different diameter configurations. Conveyor 204A shows the fixed arm 236 and moveable arm 240 separated by a distance D6. Strut 210 is mechanically coupled to moveable arm 240. A mover such as a threaded shaft or pneumatic cylinder (not shown) can push the strut 210 to change the distance between the fixed arm 236 and moveable arm 240. Roller plate 241 is affixed to the moveable arm 240, and moves along conveyor rail 243. Conveyor 204B shows a latitudinal conveyor having the fixed arm 236 and moveable arm 240 separated by a distance D5, where D5>D6. Thus, conveyor 204B is configured to handle a larger diameter cage than conveyor 204A.

Figure 12:
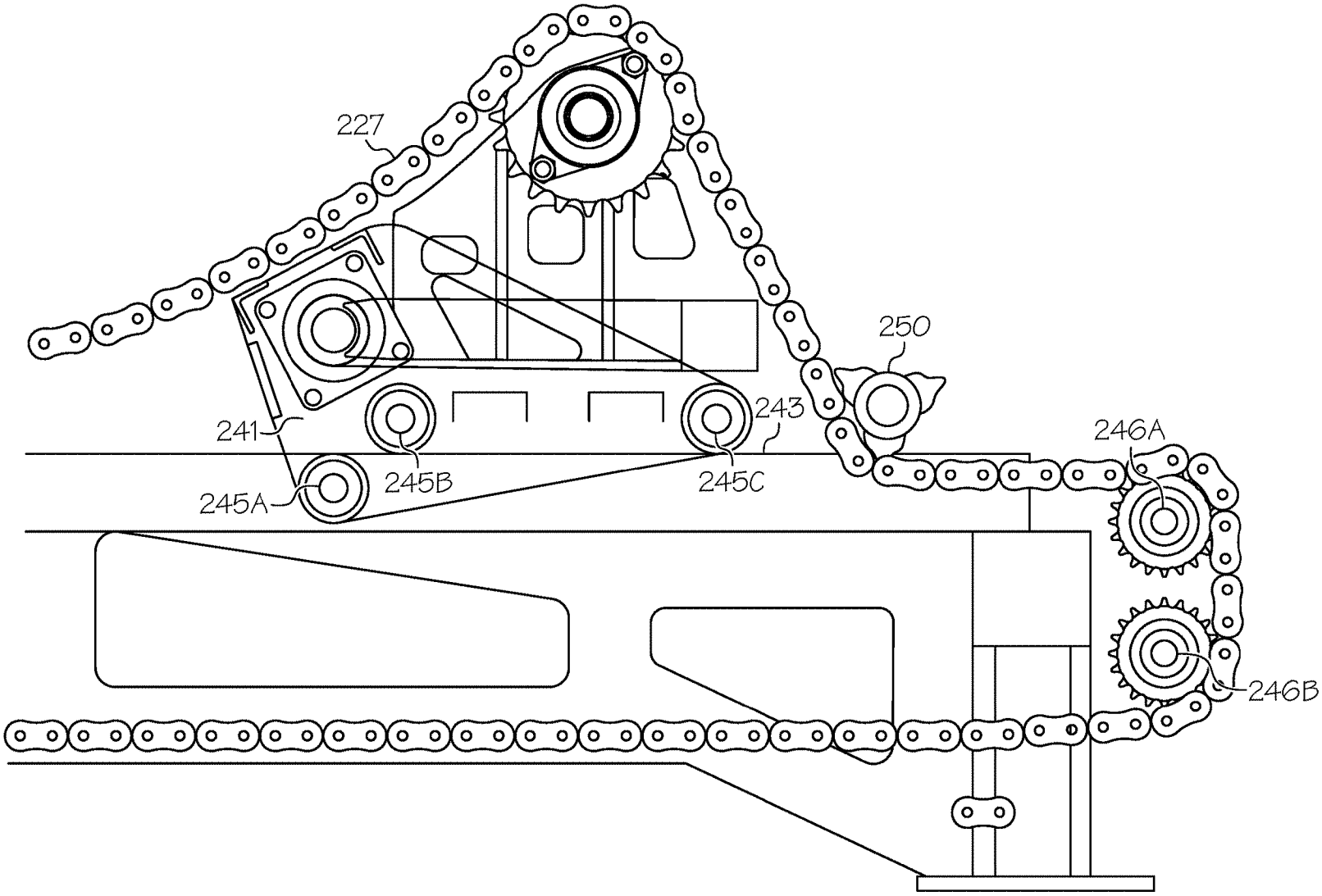
FIG. 12 shows details of a bushing arrangement within a latitudinal conveyor in accordance with an embodiment of the present invention.

FIG. 12 shows a cutaway view revealing details of a roller arrangement in a latitudinal conveyor in accordance with an embodiment of the present invention. Roller plate 241 comprises three rollers indicated as 245A, 245B, and 245C. The rollers are in physical contact with conveyor rail 243. Roller 245A is disposed below the conveyor rail 243, and roller 245B and 245C are both disposed above the conveyor rail 243. As can be seen in FIG. 12, chain 227 is disposed around two end gears, indicated as 246A and 246B. End gear 246A is disposed directly above, but not in contact with, end gear 246B. Tensioner guide 250 serves to maintain proper tension in chain 227 as the moveable arm is adjusted to new positions to accommodate different sizes of cage.

Figure 13:
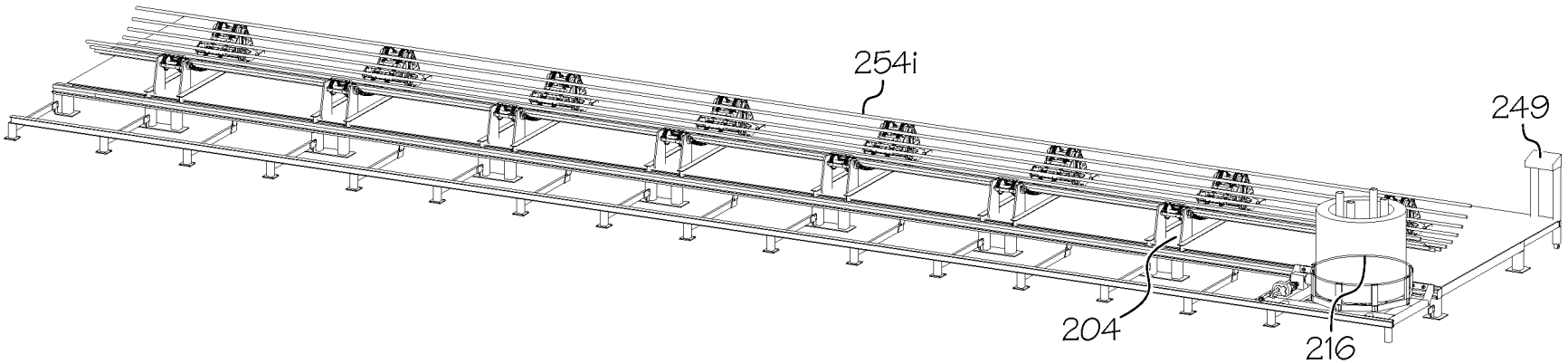
FIG. 13 shows an example of initial rod placement.

FIG. 13 shows an example of initial rod placement. Initial rods, an example of which is labeled 254*i*, are placed on the plurality of latitudinal conveyors, an example of which is indicated generally as 204. A controller 249 guides an operator though the rebar cage making process. Once the initial parameters of the cage are programmed into the controller, the first step is the placement of the initial rods. The initial parameters may include, but are not limited to, cage diameter, rod quantity, rod size, number of cage notches, and cage length. The wagon 216 is configured to contain wire that gets wrapped around the cage during the spiraling process.

Figure 14:
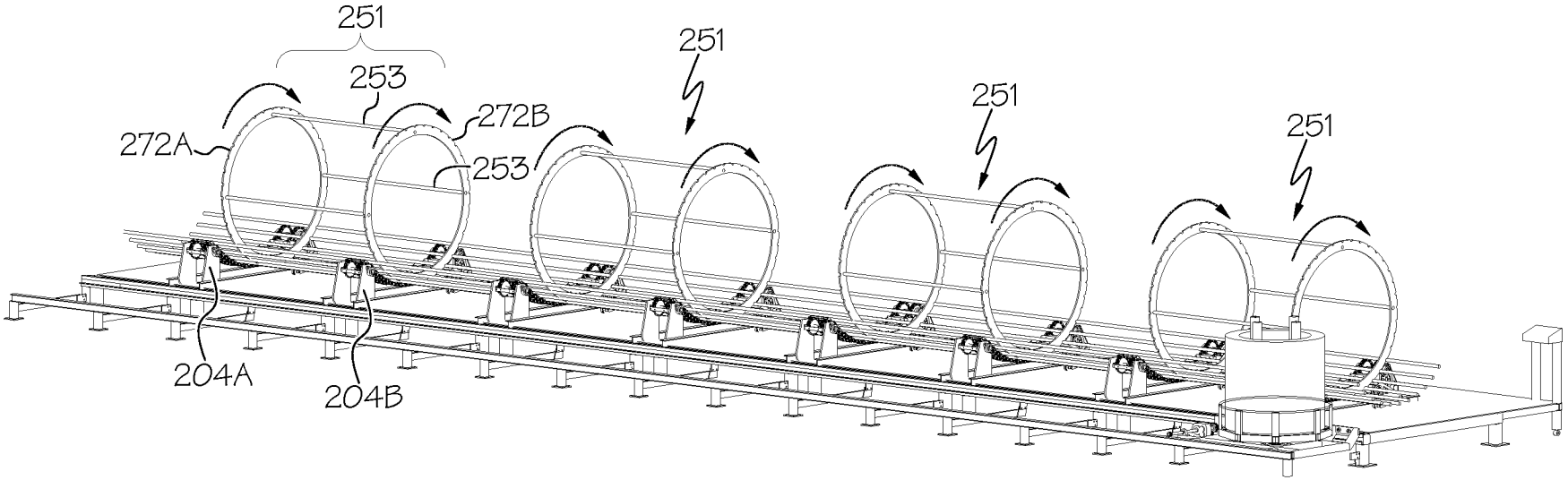
FIG. 14 shows an example of dual cage ring assembly placement.

FIG. 14 shows an example of cage placement. Once the initial rods are placed on the conveyor, (as shown in FIG. 13), cage rings are placed on the initial rods. In embodiments, a plurality of dual cage ring assemblies, each example being indicated generally as 251, may be placed on the initial rods. Each dual cage ring assembly 251 comprises a first cage ring 272A and a second cage ring 272B, interconnected by a plurality of connector bars 253. The length of the connector bars are selected such that cage ring 272A and cage ring 272B each align with a respective latitudinal conveyor 204A and 204B.

Figure 15:
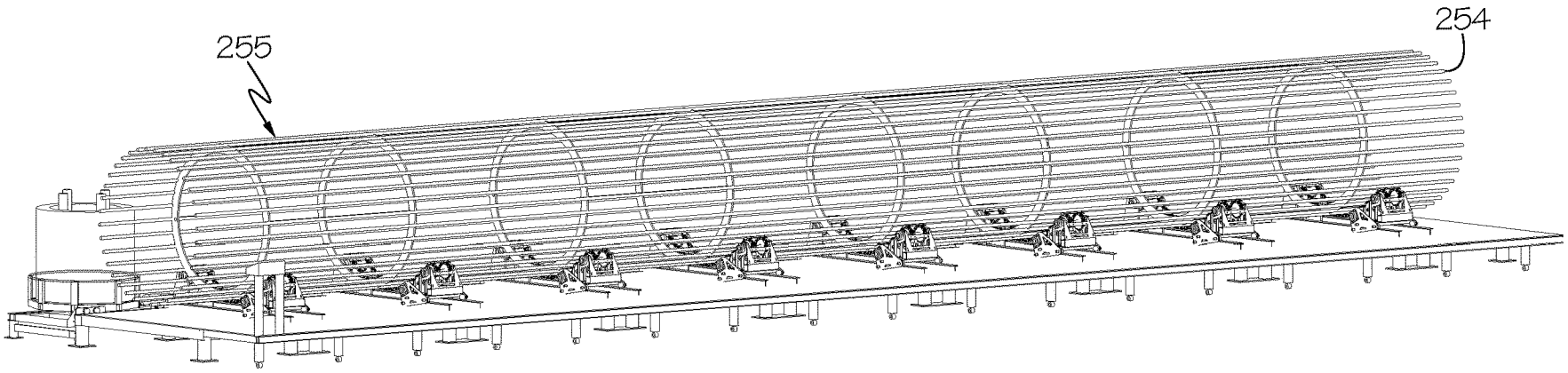
FIG. 15 shows an example of completion of the barreling process.

FIG. 15 shows an example of completion of the barreling process. The barreling process, as indicated in FIG. 7, includes rotation of cage rings and dispensing of rods into slots within the cage rings. In embodiments, after each rod is inserted into the slots of the cage rings, it may be fastened to the cage rings via wire, clamps, tack welding, or other suitable mechanism. All the rods are on the outside of the cage rings. Once all the intended cage slots are occupied by a rod, an example of which is labeled as 254, the barrel 255 is complete, and the spiraling process can begin.

Figure 16:
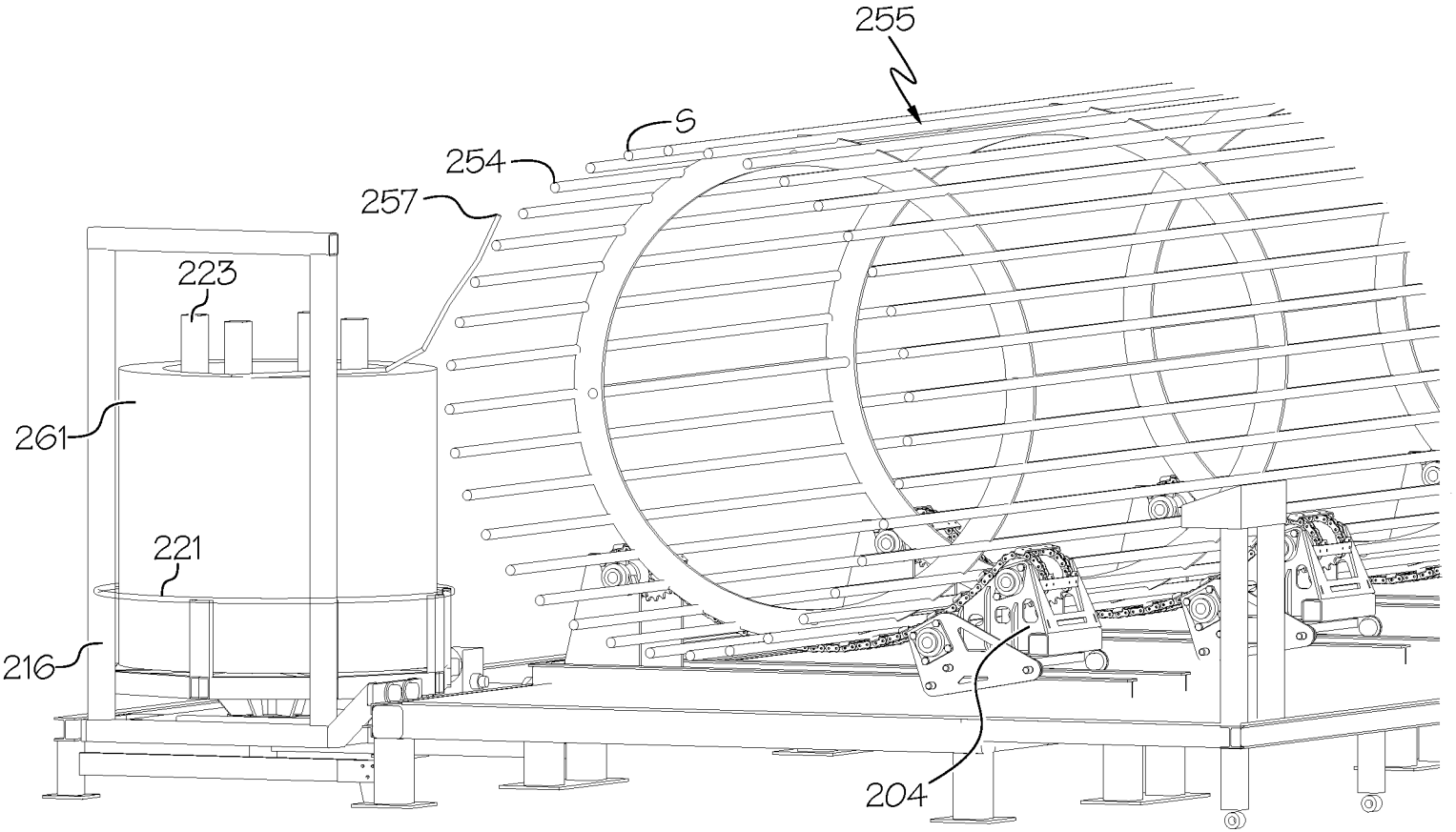
FIG. 16 shows the start of the spiraling process.

FIG. 16 shows the start of the spiraling process. A spool 261 of spiraling wire is placed on the spindle(s) 223 of wagon 216 and is secured by the wagon cage 221. To start the spiraling process, an operator attaches the end of the spiral wire 257 to a start point S on the barrel 255. The attachment may be made with twisted wire, clamps, tack welding, or other suitable mechanism. The latitudinal conveyors 204 are then activated to spin the barrel 255, while simultaneously, the wagon 216 moves along the long axis of the barrel 255.

Figure 17:
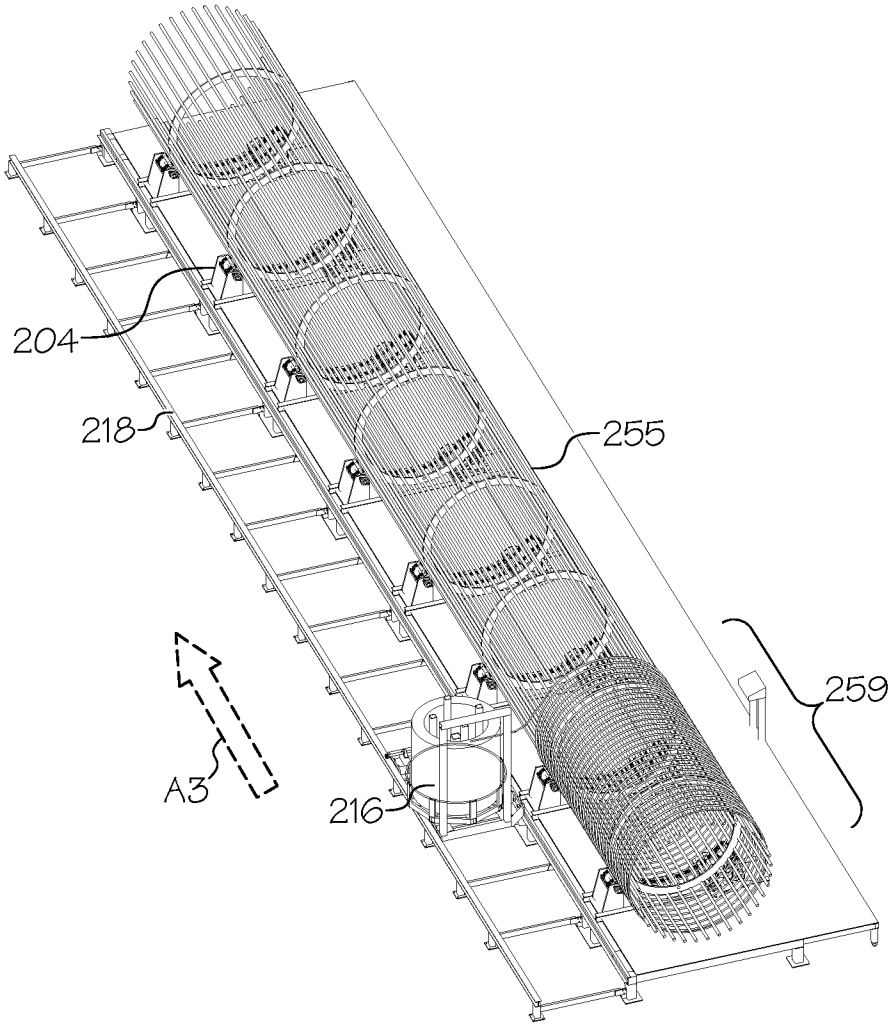
FIG. 17 shows a perspective view of an apparatus with the spiraling process in progress.

FIG. 17 shows a perspective view of an apparatus with the spiraling process in progress. As can be seen in FIG. 17, the rebar cage has a spiraled section 259 where the spiraling has already completed. The wagon 216 is moving in the direction indicated by arrow A3, along wagon rail 218, which is oriented along the long axis of the barrel 255. As the wagon 216 moves in the direction indicated by arrow A3, the latitudinal conveyors 204 are rotating to allow the spiraling of wire around the barrel 255. In embodiments, more than one spiral may be formed around the barrel. Thus, the spiraling process may be performed more than once on the barrel.

Figure 18:
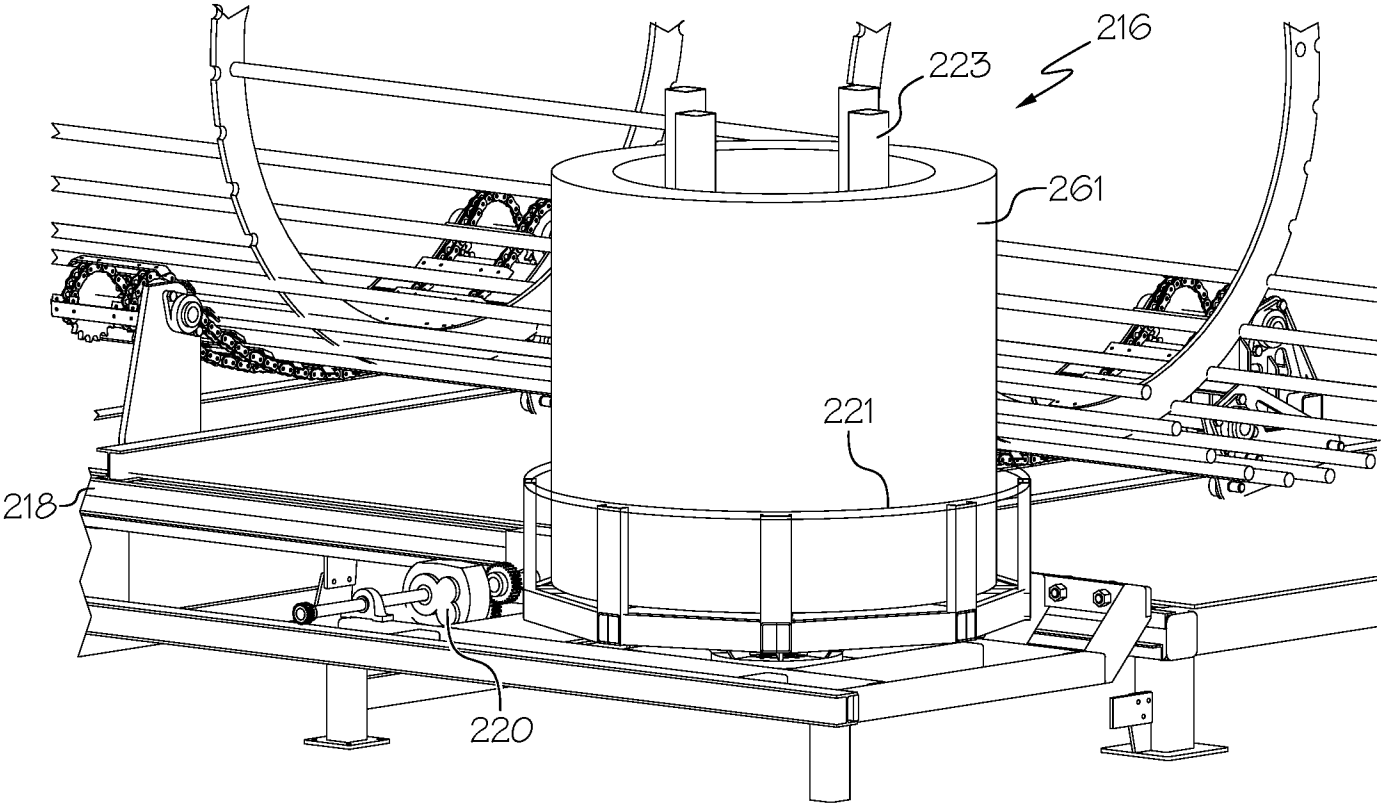
FIG. 18 shows details of a wagon.

FIG. 18 shows details of a wagon. A spool 261 of spiraling wire is placed on the wagon 216, held in place by one or more spindles, an example of which is labeled as 223, and a wagon cage 221. The spindles 223 allow the spool to rotate during the spiraling process, such that wire can be drawn from the spool 261 as the wagon is moved along the wagon rail 218. The wagon motor 220 moves the wagon 216 along the wagon rail 218 at a predetermined speed. The wagon speed, along with the speed of the lateral conveyors, determines the pitch of the spiral wire that wraps around the barrel.

FIGS. 19-24 show exemplary computer-implemented user interface screens. The user interface screens may be implemented on a touch screen display, a computer, a mobile device, or any other suitable user interface. In embodiments, a computerized controller (see 249 of FIG. 13) is used to control the operation of the apparatus. The computerized controller comprises a processor (see 126 of FIG. 1) and a memory (see 128 of FIG. 1) containing instructions. In embodiments, the memory contains instructions, that when executed by the processor, control operation of the first motor (for the latitudinal conveyors) and the second motor (for the wagon), and perform the steps of prompting a user to load the initial plurality of rods via the user interface, prompting a user to load the plurality of dual-ring cages, detecting a dispensing position of the plurality of dual-ring cage assemblies, and dispensing a rod into the notch of the plurality of dual-ring cage assemblies. The memory 128 may include dynamic random access memory (DRAM), static random access memory (SRAM), magnetic storage, and/or a read only memory such as flash, EEPROM, optical storage, or other suitable memory. In some embodiments, the memory 128 may not be a transitory signal per se. In embodiments, the controller is configured to accept an input of cage diameter, rod quantity, rod size, number of cage notches, and cage length. The controller may also be configured to accept an input of cage start position, spiral start position, spiral end position, spiral pitch, and number of spirals.

The controller serves to guide operators through the fabrication process. Embodiments include a sequence that comprises placing an initial plurality of rods on a plurality of latitudinal conveyors, placing a plurality of dual-ring cage assemblies on the initial plurality of rods, operating the plurality of latitudinal conveyors to rotate the plurality of dual-ring cage assemblies to a rod reception position, dispensing a rod into a notch of the plurality of dual-ring cage assemblies, repeating the operating and dispensing until a predetermined number of rods are dispensed, connecting a spiral wire to one of the plurality of rods, and operating the plurality of latitudinal conveyors simultaneously while operating a wagon along a longitudinal rail to create a spiral wire around the plurality of dual-ring cage assemblies.

Figure 19:
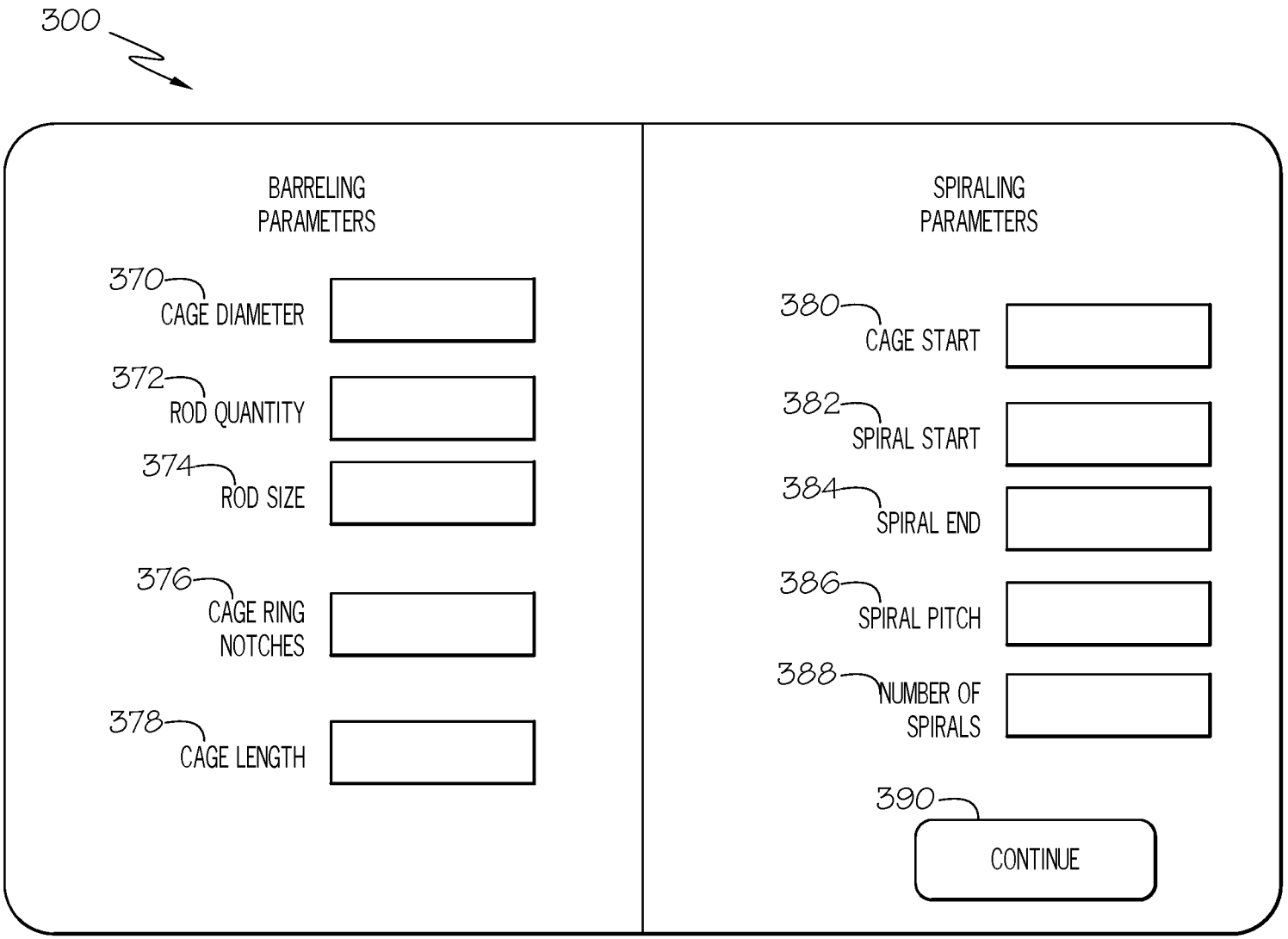
FIG. 19 shows an exemplary user interface for data entry.

FIG. 19 shows an exemplary user interface for data entry. User interface 300 comprises a plurality of data entry fields. Field 370 allows a user to input a cage diameter. Field 372 allows a user to input a rod quantity. Field 374 allows a user to enter a rod size, which may include a rod diameter and/or a rod length. Field 376 allows a user to enter a number of cage ring notches or slots (see 174 of FIG. 6). Field 378 allows a user to enter a cage length. Field 380 allows a user to enter a cage start. Field 382 allows a user to enter a spiral start location. Field 384 allows a user to enter a spiral end location. Field 386 allows a user to enter a spiral pitch value. Field 388 allows a user to enter a number of spirals. Button 390 is a continue button that allows the operator to proceed to the cage building process. In embodiments, the processor (126 of FIG. 1) may perform validation checking on the entered data. Warnings or errors may be generated if the validation checks fail. For example, if rod quantity 372 exceeds the cage ring notches 376, a warning or error may be presented to the user via user interface 300.

Figure 20:
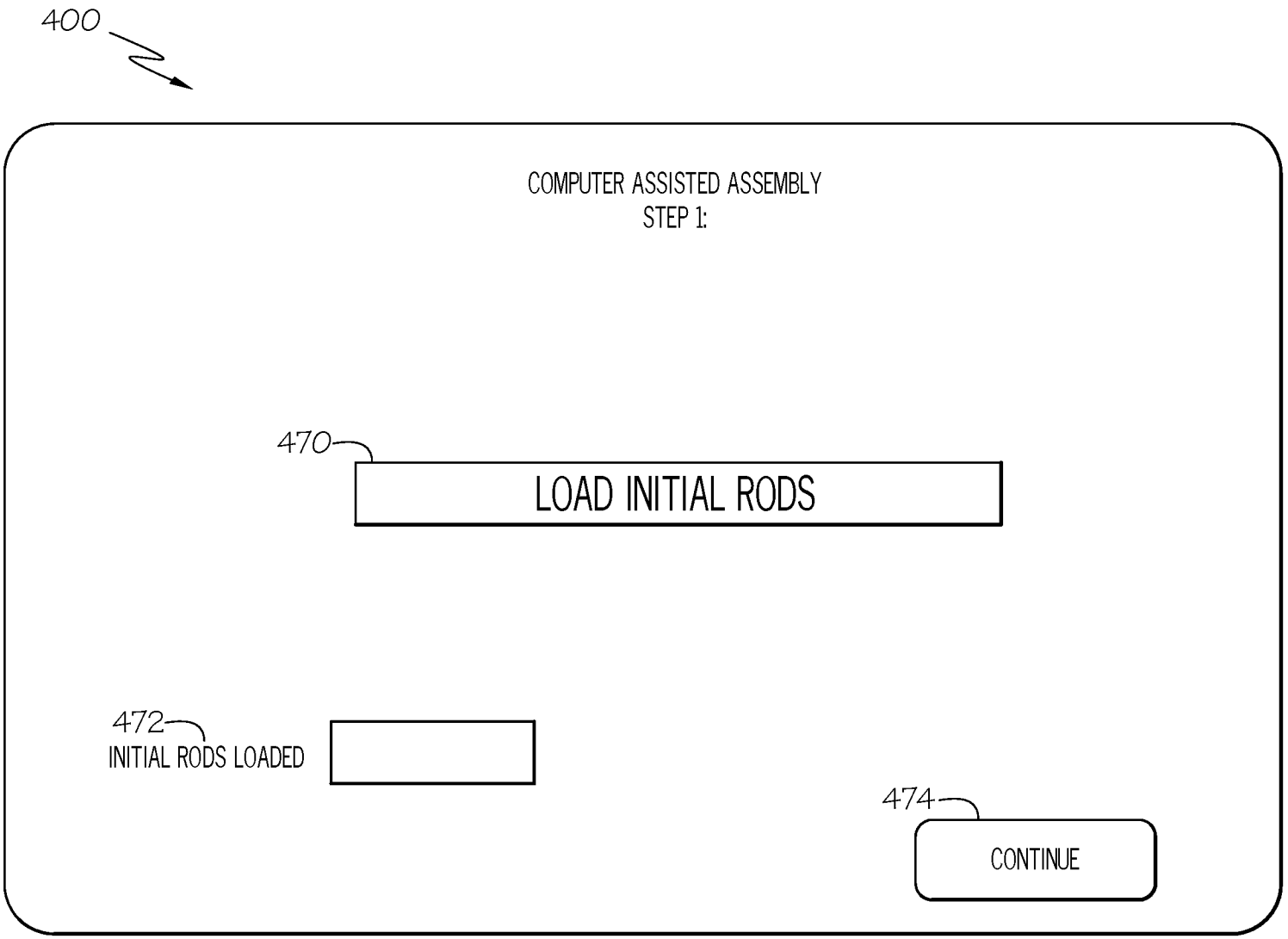
FIG. 20 shows an exemplary user interface for initial rod loading.

FIG. 20 shows an exemplary user interface 400 for initial rod loading. The user (operator) is prompted by operator message 470 to load the initial rods. The operator enters the number of initial rods loaded in field 472. The operator then presses the continue button 474 to continue to the next step.

Figure 21:
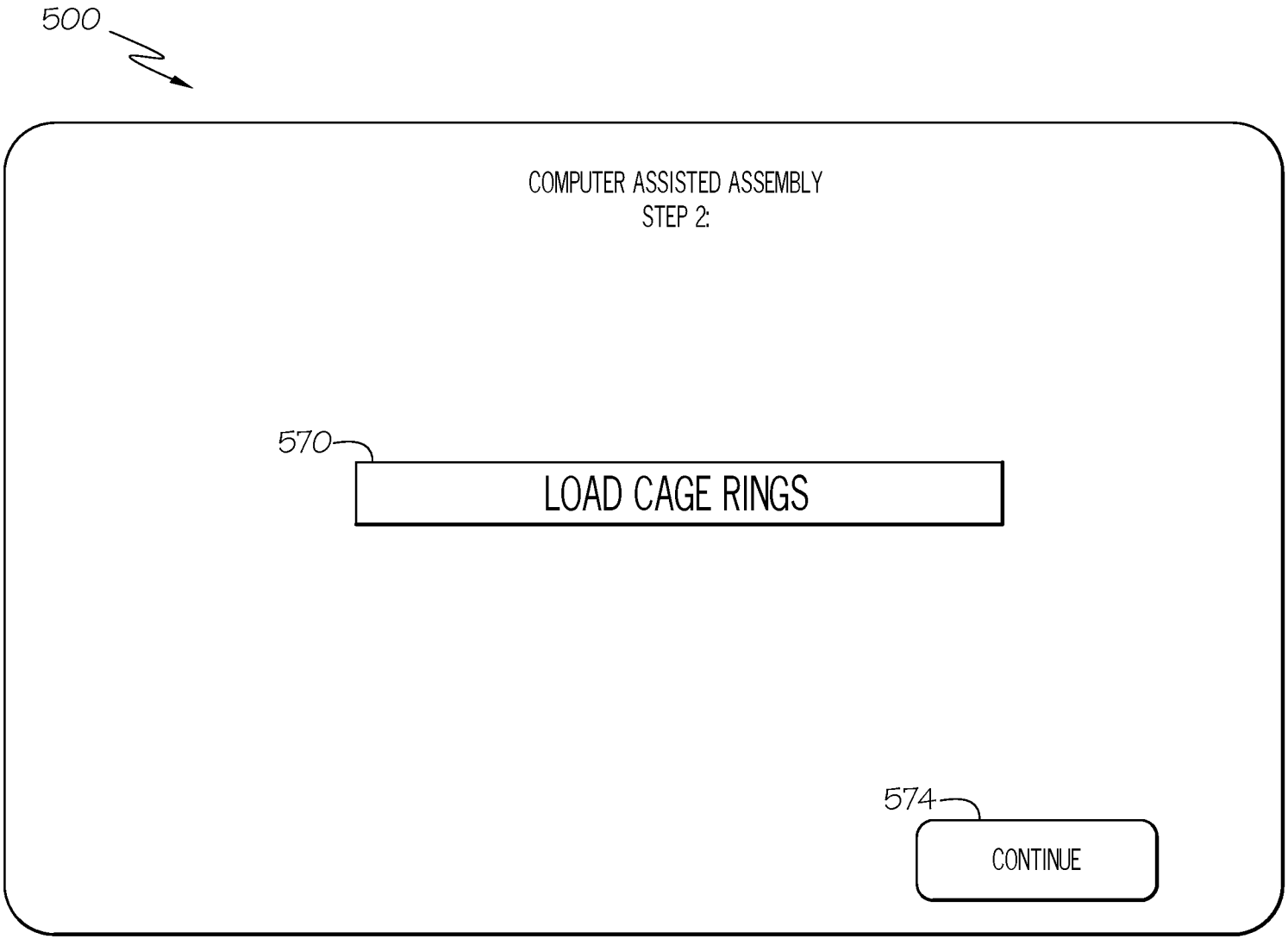
FIG. 21 shows an exemplary user interface for cage loading.

FIG. 21 shows an exemplary user interface 500 for cage ring loading. The user is prompted by operator message 570 to load the cage rings. This may include loading a plurality of dual-ring cage assemblies as shown in FIG. 14. The dual-ring cage assemblies may be loaded via a crane. Once the cage rings are loaded, the operator then presses the continue button 574 to continue to the next step.

Figure 22:
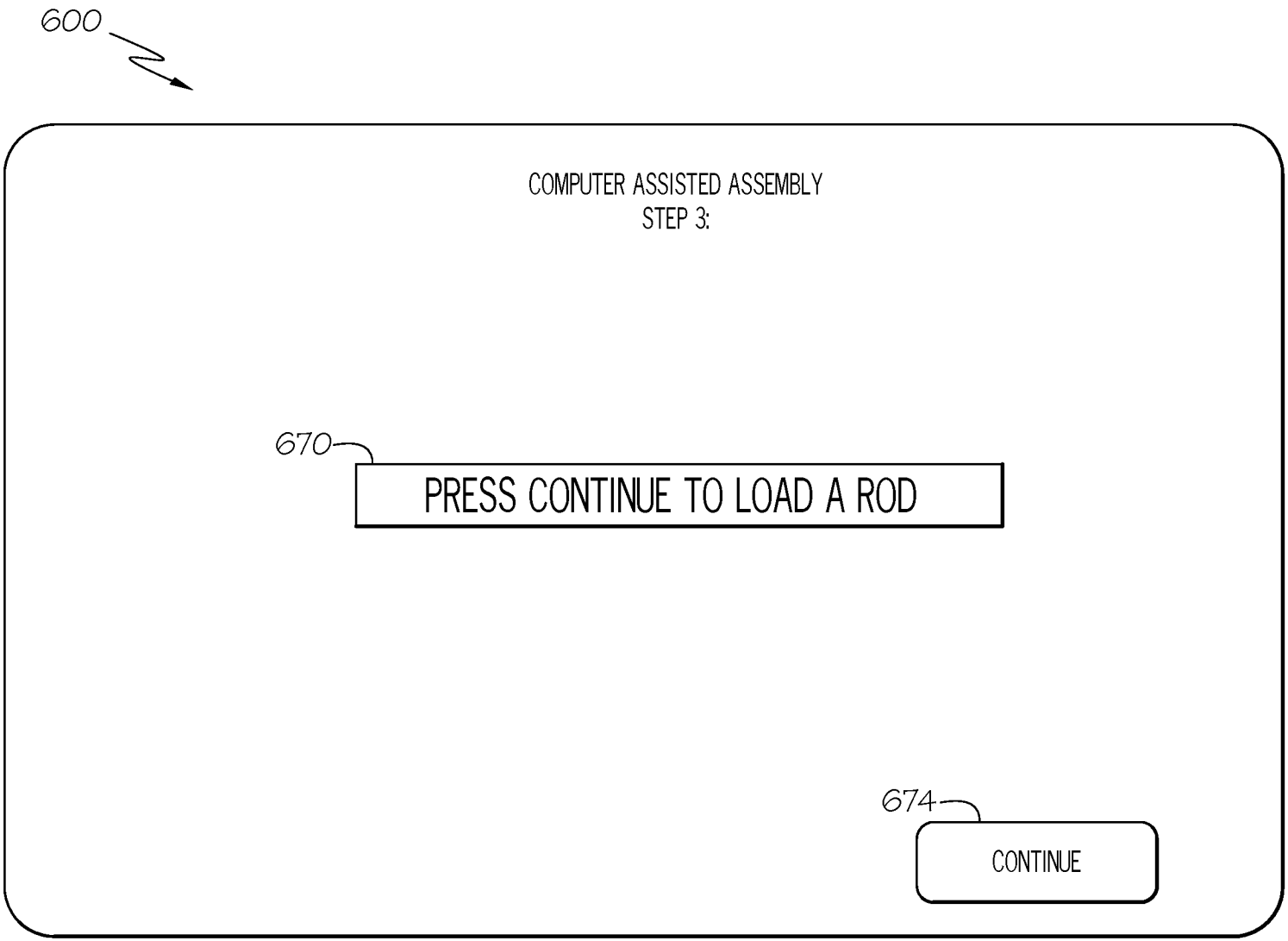
FIG. 22 shows an exemplary user interface for loading an additional rod.

FIG. 22 shows exemplary user interface 600 for loading an additional rod. The user (operator) is prompted by operator message 670 to load a rod (as shown in FIG. 7). When the operator is ready, the operator then presses the continue button 674 to continue to activate the rod dispenser to load the rod as illustrated in FIG. 7.

Figure 23:
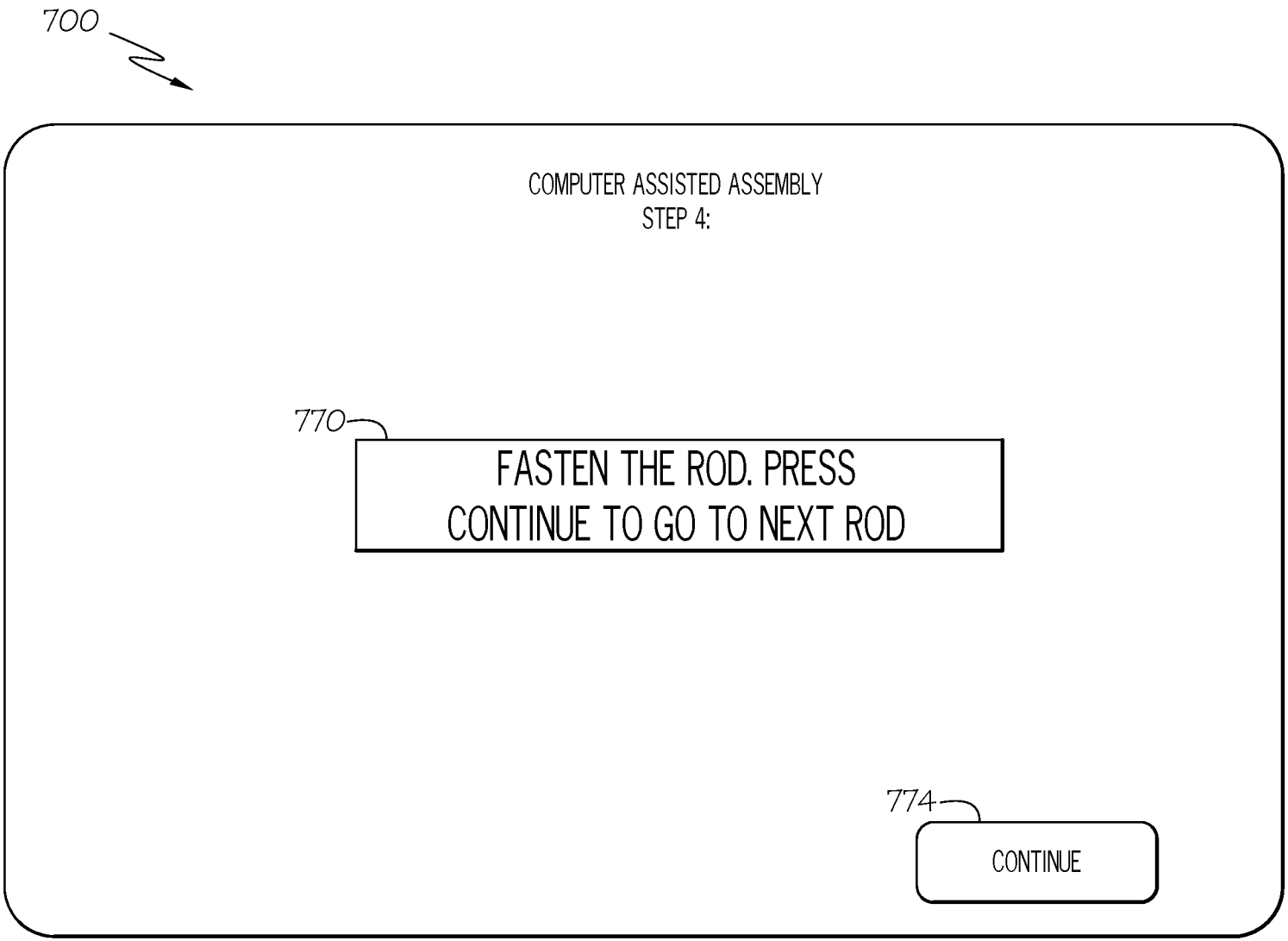
FIG. 23 shows an exemplary user interface for loading a subsequent rod.

FIG. 23 shows an exemplary user interface 700 for loading a subsequent rod. The user (operator) is prompted by operator message 770 to fasten the rod to the cages. When the fastening is complete, the user presses the continue button 774 to continue the process until the total number of rods (374 of FIG. 19) have been installed. The number of dispensed rods equals the total number of rods minus the number of initial rods.

Figure 24:
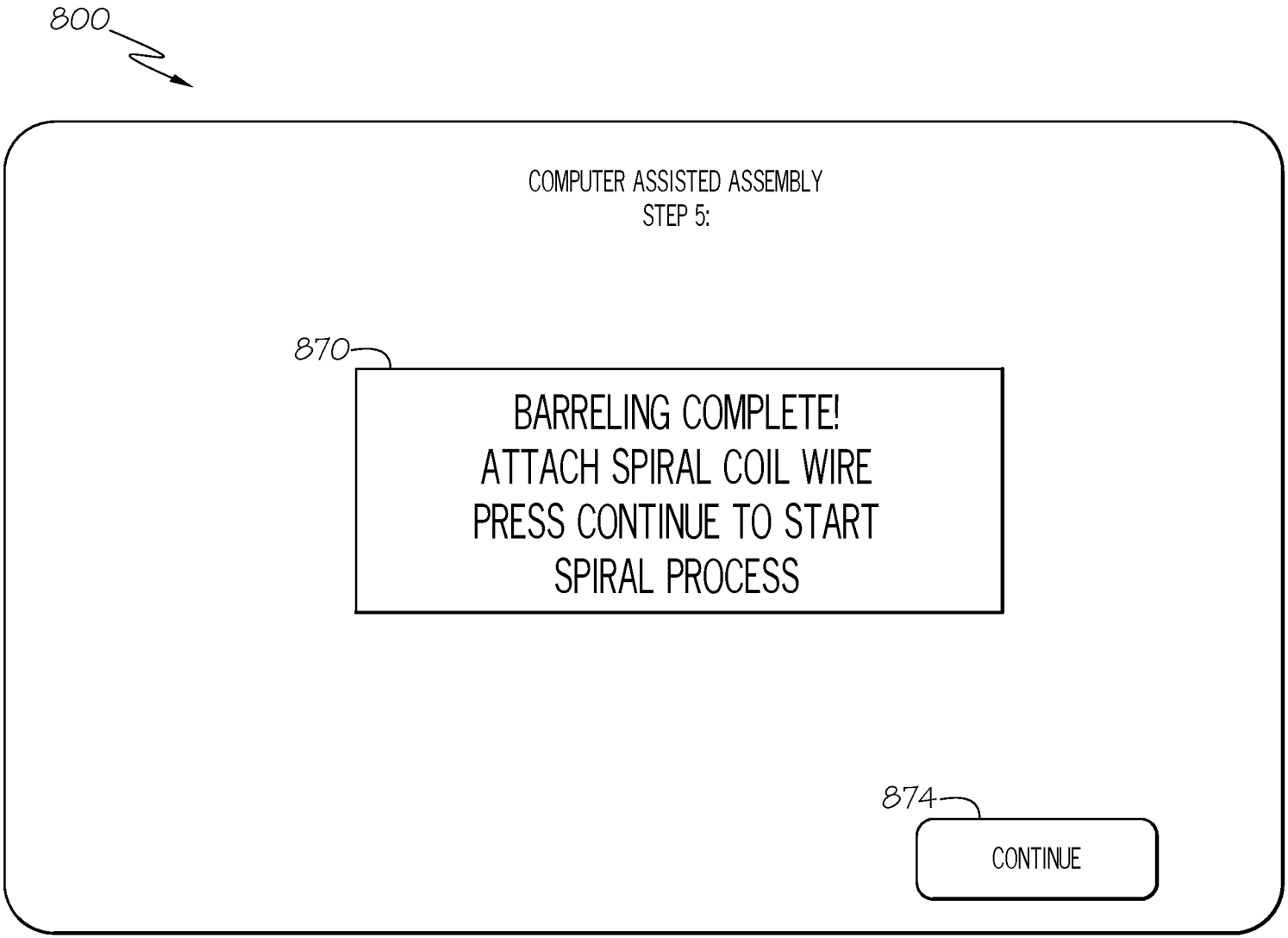
FIG. 24 shows an exemplary user interface for starting the spiraling process.

FIG. 24 shows an exemplary user interface 800 for starting the spiraling process. At this point in the process, the barreling is complete. The user (operator) is prompted by operator message 870 to attach the spiral wire (see 257 of FIG. 16). The user then presses continue button 874 to start the spiral process as illustrated in FIG. 17.

The user interfaces of FIGS. 19-24 are non-limiting examples. In implementations, the screens may be configured differently. For instance, more or fewer elements may be included. Fields could instead be drop down menus, radio buttons, or other suitable input device. The elements could be displayed in portions of the interface varying from those shown, etc.

As will now be apparent, embodiments of the present invention provide an improved method and apparatus for rebar cage construction. A computerized controller operates an apparatus that automates parts of the rebar cage formation process. The computer controls motors for rotating the barrel and operating a wagon containing spiral coil wire. In some embodiments, the fastening of the rods to the cage rings may also be automated. For example, robotic welding devices can perform a tack weld to keep the bars in place. The apparatus helps to ensure that the rebar cage is properly fabricated such that it has the structural and dimensional stability intended as per its design. In other embodiments, the fastening of the rods to the cage ring may be a manual process, such as utilizing ductile steel wire that is tied by hand, and wrapped around each ring-to-bar intersection and twisted tightly together.

While the invention has been particularly shown and described in conjunction with exemplary embodiments, it will be appreciated that variations and modifications will occur to those skilled in the art. In particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Although some of the illustrative embodiments are described herein as a series of acts or events, it will be appreciated that the present invention is not limited by the illustrated ordering of such acts or events unless specifically stated. Some acts may occur in different orders and/or concurrently with other acts or events apart from those illustrated and/or described herein, in accordance with the invention. In addition, not all illustrated steps may be required to implement a methodology in accordance with the present invention. Furthermore, the methods according to the present invention may be implemented in association with the formation and/or processing of structures illustrated and described herein as well as in association with other structures not illustrated. Therefore, it is to be understood that the appended claims are intended to cover all such modifications and changes that fall within the true spirit of the invention.

What is claimed is:

1. An apparatus comprising:

a driveshaft;

a first motor coupled to the driveshaft;

a plurality of latitudinal conveyors coupled to the driveshaft, wherein each conveyor comprises a plurality of rod guides;

a longitudinal rail disposed alongside the plurality of latitudinal conveyors;

a wagon configured to travel along the longitudinal rail such that it passes adjacent to each of the plurality of latitudinal conveyors;

a second motor configured to move the wagon along the longitudinal rail; and a controller comprising a processor and a memory containing instructions, that when executed by the processor, control operation of the first motor and the second motor;

wherein each conveyor of the plurality of latitudinal conveyors comprises a fixed arm and a moveable arm, and wherein a first fixed arm pulley is attached to the fixed arm, and wherein a first moveable arm pulley is attached to the moveable arm.

2. The apparatus of claim 1, further comprising a position sensor configured and disposed to detect a dispensing position of a dual-ring cage assembly disposed on two of the plurality of latitudinal conveyors.

3. The apparatus of claim 2, wherein the position sensor comprises a magnetic proximity sensor.

4. The apparatus of claim 2, wherein the position sensor comprises a laser sensor.

5. The apparatus of claim 1, wherein the apparatus further comprises an extension mechanism configured and disposed to move the moveable arm of each latitudinal conveyor in a latitudinal direction to adjust a cage diameter.

6. The apparatus of claim 5, wherein the extension mechanism comprises a pneumatic cylinder.

7. The apparatus of claim 1, further comprising an encoder configured to measure a distance travelled by the wagon.

8. The apparatus of claim 1, wherein each of the plurality of latitudinal conveyors comprises a second fixed arm pulley attached to the fixed arm and a second moveable arm pulley attached to the moveable arm, and a first chain and a second chain, wherein the first chain is coupled to the first fixed arm pulley and the first moveable arm pulley, and wherein the second chain is coupled to the second fixed arm pulley and the second moveable arm pulley, and wherein the first chain is connected to the second chain by the plurality of rod guides.

9. The apparatus of claim 2, further comprising a rod dispensing mechanism configured and disposed to dispense a rod into a slot of a cage ring that is disposed on the plurality of latitudinal conveyors.

10. The apparatus of claim 9, wherein the dispensing mechanism comprises:

a piston;

a first arm, the first arm mechanically coupled to the piston;

a second arm, the second arm mechanically coupled to the first arm;

a rod holder disposed at a distal end of the second arm; wherein in the first arm and second arm are configured and disposed such that when the piston extends, the rod holder is moved to the dispensing position.

11. An apparatus comprising:

a driveshaft;

a first motor coupled to the driveshaft;

a plurality of latitudinal conveyors coupled to the driveshaft, wherein each conveyor comprises a plurality of rod guides;

a longitudinal rail disposed alongside the plurality of latitudinal conveyors;

a wagon configured to travel along the longitudinal rail such that it passes adjacent to each of the plurality of latitudinal conveyors;

a second motor configured to move the wagon along the longitudinal rail; and a controller comprising a processor, a user interface coupled to the processor, and a memory containing instructions, that when executed by the processor, control operation of the first motor and the second motor, and perform the steps of:

prompting a user to load an initial plurality of rods via the user interface;

prompting a user to load a plurality of dual-ring cage assemblies;

detecting a dispensing position of the plurality of dual-ring cage assemblies; and dispensing a rod into a notch of the plurality of dual-ring cage assemblies.

12. The apparatus of claim 11, wherein detecting a dispensing position comprises reading a signal from a magnetic proximity sensor to determine a location of the notch.

13. The apparatus of claim 11, wherein detecting a dispensing position comprises reading a signal from a laser sensor to determine a location of the notch.

14. The apparatus of claim 11, wherein the controller is configured to accept an input of cage diameter, rod quantity, rod size, number of cage notches, and cage length.

15. The apparatus of claim 14, wherein the controller is configured to accept an input of cage start position, spiral start position, spiral end position, spiral pitch, and number of spirals.

* * * * *